US007581825B2

(12) United States Patent
Watanabe et al.

(10) Patent No.: US 7,581,825 B2
(45) Date of Patent: Sep. 1, 2009

(54) INKJET HEAD AND A METHOD OF MANUFACTURING THEREOF

(75) Inventors: Hidetoshi Watanabe, Tokoname (JP); Shin Ishikura, Kokubu (JP)

(73) Assignees: Brother Kogyo Kabushiki Kaisha, Nagoya-shi, Aichi-ken (JP); Kyocera Corporation, Kyoto-shi, Kyoto-fu (JP)

( * ) Notice: Subject to any disclaimer, the term of this patent is extended or adjusted under 35 U.S.C. 154(b) by 325 days.

(21) Appl. No.: 11/302,521

(22) Filed: Dec. 14, 2005

(65) Prior Publication Data

US 2006/0164476 A1 Jul. 27, 2006

(30) Foreign Application Priority Data

Dec. 14, 2004 (JP) ..... 2004-360759

(51) Int. Cl.
*B41J 2/175* (2006.01)
*B41J 2/045* (2006.01)

(52) U.S. Cl. ..... 347/85; 347/68; 347/71; 347/72

(58) Field of Classification Search ..... 347/58–59, 347/72, 71

See application file for complete search history.

(56) References Cited

U.S. PATENT DOCUMENTS 6,547,376 B1 * 4/2003 Watanabe et al. ..... 347/70
6,672,715 B2 1/2004 Isono et al.
2002/0196315 A1 12/2002 Isono et al.
2003/0156167 A1 8/2003 Sakaida et al.
2004/0218018 A1 11/2004 Sakaida et al.
2005/0185028 A1 8/2005 Sakaida et al.
2006/0125878 A1 6/2006 Watanabe

FOREIGN PATENT DOCUMENTS

EP 1336494 A1 8/2003
JP 7 156397 6/1995
JP 2001-309672 A 11/2001

OTHER PUBLICATIONS

European Patent Office, European Search Report for EP Application No. 05027105 mailed Jan. 15, 2007.
U.S. Patent and Trademark Office, Office Action in U.S. Appl. No. 11/302,459 (co-pending application to above-captioned U.S. patent application), dated Jun. 13, 2008.

* cited by examiner

*Primary Examiner*—K. Feggins
*Assistant Examiner*—Lisa M Solomon
(74) *Attorney, Agent, or Firm*—Baker Botts LLP

(57) ABSTRACT

To provide an inkjet head that maintains a reliable electric connection between a flow channel unit and a common electrode of an actuator unit, a flow channel unit is provided with a cavity formed on an attachment surface of flow channel unit to attach to an actuator unit, and the actuator unit is provided with a contact terminal connected to the common electrode and formed at a position facing the cavity when the flow channel unit and the actuator unit are attached. The common electrode is reliably connected to the flow channel unit through the contact terminal and a conductive material filling the cavity.

10 Claims, 13 Drawing Sheets

(a)

(b)

INKJET HEAD AND A METHOD OF MANUFACTURING THEREOF

CROSS-REFERENCE TO RELATED APPLICATION

This application claims priority to Japanese Patent Application No. 2004-360759 filed on Dec. 14, 2004, the contents of which are hereby incorporated by reference into the present application.

BACKGROUND OF THE INVENTION

1. Field of the Invention

The present invention relates to an inkjet head that performs printing operation by discharging ink onto a recording medium such as a printing sheet. The present invention also relates to a method of manufacturing the inkjet head.

2. Description of the Related Art

An inkjet head of an inkjet printer includes a flow channel unit and an actuator unit. The flow channel unit includes a plurality of nozzles and a plurality of pressure chambers. Each pressure chamber is connected to a uniquely corresponding nozzle, and ink is discharged from the nozzle when a pressure within the pressure chamber corresponding to the nozzle is increased. The actuator unit includes a plurality of actuators. Each actuator faces a uniquely corresponding pressure chamber when the actuator unit is attached to the flow channel unit. When one of the actuator is selected and activated, the pressure within the pressure chamber uniquely corresponding to the activated actuator is increased and ink is discharged from the nozzle uniquely corresponding to the activated actuator and the pressure chamber.

Japanese Laid-Open Patent Application Publication No. 2003-80709 discloses an actuator unit having a piezoelectric sheet, a common electrode and a plurality of individual electrodes. The piezoelectric sheet is interposed between the common electrode and the plurality of individual electrodes. The common electrode is formed over a plurality of pressure chambers when the actuator unit is attached to the flow channel unit. Each of the plurality of individual electrodes is disposed to face the uniquely corresponding pressure chamber.

In this inkjet head, a conductive adhesive is applied on a side end face of the actuator unit from an upper surface of the flow channel unit. Because the common electrode (internal electrode) of the actuator unit extends to a peripheral border of the piezoelectric sheet, the common electrode is electrically connected to the flow channel unit via the conductive adhesive applied on the side end face of the actuator unit.

When a potential difference exists between the flow channel unit and the common electrode of the actuator unit, moisture from the ink within the flow channel unit is electrolyzed, and hydrogen ions ($H^+$) are consequently generated. If the common electrode of the actuator unit is on the negative side, the generated hydrogen ions move to the common electrode, and the common electrode occludes the hydrogen ions and expands. In this way, when a potential difference arises between the flow channel unit and the common electrode of the actuator unit, the actuator unit can be damaged by the expansion of the common electrode (internal electrode).

In the inkjet head disclosed in Japanese Laid-Open Patent Application Publication No. 2003-80709, because the flow channel unit and the common electrode (internal electrode) of the actuator unit are electrically connected via the conductive adhesive applied on the side end face of the actuator unit, the difference in electrical potential between the flow channel unit and the common electrode of the actuator unit becomes zero. Accordingly, it becomes possible to prevent the actuator unit from being damaged due to migration in the common electrode of the actuator unit.

BRIEF SUMMARY OF THE INVENTION

However, in the inkjet head described in Japanese Laid-Open Patent Application Publication No. 2003-80709, because the actuator unit and the flow channel unit are fixed together with an adhesive, the adhesive can leak onto the upper surface of the flow channel unit to which the actuator unit is attached. When the leaked adhesive covers the upper surface of the flow channel unit, the flow channel unit and the common electrode of the actuator unit cannot be electrically connected, even if conductive adhesive is applied on the side end face of the actuator unit.

It may be possible to scrape off the adhesive to expose a spotless area on the upper surface of the flow channel unit, and then apply the conductive adhesive to the spotless area to electrically connect the common electrode of the actuator unit to the spotless area. However, not only is it troublesome to scrape off the adhesive, but the scum from the scraped adhesive can infiltrate a channel within the flow channel unit and cause the channel to clog up.

Hence, an objective of the present invention is to provide an inkjet head that maintains a reliable connection between a flow channel unit and a common electrode of an actuator unit without producing any dross or scum during its process of manufacturing.

Another objective of the present invention is to provide a method of manufacturing such an inkjet head.

The inkjet head of the present invention includes a flow channel unit and an actuator unit attached to the flow channel unit. The flow channel unit includes a plurality of nozzles, and a plurality of pressure chambers. Each pressure chamber is connected to a uniquely corresponding nozzle. The actuator unit includes a piezoelectric sheet, a plurality of individual electrodes and a common electrode. The plurality of individual electrodes and the common electrode sandwich the piezoelectric sheet. Each individual electrode faces a uniquely corresponding pressure chamber when the flow channel unit is attached to the actuator unit. A contact terminal is exposed on an attachment surface of the actuator unit. The flow channel unit is attached to the attachment surface of the actuator unit. The contact terminal is electrically connected to the common electrode. A cavity is formed on an attachment surface of the flow channel unit. The actuator unit is attached to the attachment surface of the flow channel unit. The cavity faces the contact terminal when the flow channel unit is attached to the actuator unit. The cavity is filled with a conductive material, and the conductive material electrically connects the contact terminal of the actuator unit with the flow channel unit.

According to this configuration, when the flow channel unit and the actuator unit are attached, the flow channel unit and the common electrode of the actuator unit can be electrically connected without having to scrape off the adhesive that covers the flow channel unit. Accordingly, it becomes possible to electrically connect the flow channel unit and the common electrode of the actuator unit with high reliability, without clogging an ink channel within the flow channel unit. As a result, the difference in electrical potential between the flow channel unit and the common electrode of the actuator unit becomes zero, and migration becomes improbable.

A method of manufacturing an inkjet head according to the invention includes a step of fabricating a flow channel unit having a cavity on a flat surface, a step of applying an adhesive on the flat surface of the flow channel unit, a step of filling a conductive material within the cavity of the flow channel unit, a step of fabricating an actuator unit, and a step of attaching the actuator unit to the flow channel. The flow channel unit to be fabricated includes a plurality of nozzles, a plurality of pressure chambers, each pressure chamber being connected to a uniquely corresponding nozzle; and the cavity formed on the flat surface of the flow channel unit. The actuator unit to be fabricated includes a piezoelectric sheet; a plurality of individual electrodes; a common electrode which, with the plurality of individual electrodes, sandwiches the piezoelectric sheet; and a contact terminal electrically connected to the common electrode and exposed on an attachment surface of the actuator unit. The flat surface of the flow channel unit is attached to the attachment surface of the actuator unit. The flow channel unit and the actuator unit are attached each other so that each of the plurality of individual electrodes faces a uniquely corresponding pressure chamber and so that the contact terminal contacts the conductive material filled in the cavity.

According to this method, when attaching the flow channel unit to the actuator unit, the flow channel unit and the common electrode of the actuator unit can be electrically connected without having to scrape off the adhesive that covers the flow channel unit. Accordingly, it becomes possible to electrically connect the flow channel unit and the common electrode of the actuator unit with high reliability, without clogging an ink channel within the flow channel unit. As a result, the difference in electrical potential between the flow channel unit and the common electrode of the actuator unit becomes zero, and migration becomes improbable.

DETAILED DESCRIPTION OF THE INVENTION

Preferred embodiments of the present invention will be described below with reference to the figures.

Figure 1:
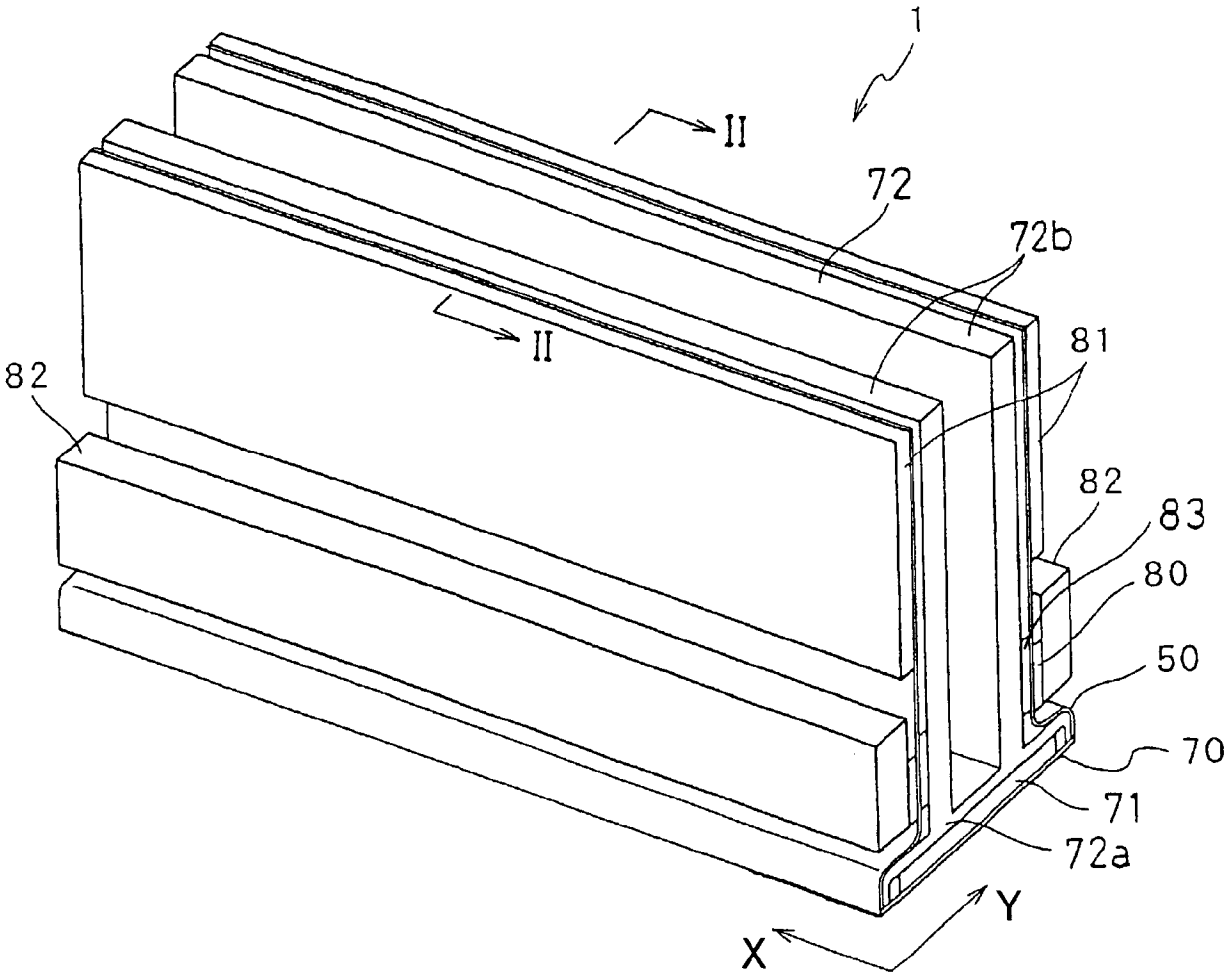
FIG. 1 is an external perspective diagram of an inkjet head assembly according to a first embodiment of the present invention.
Figure 2:
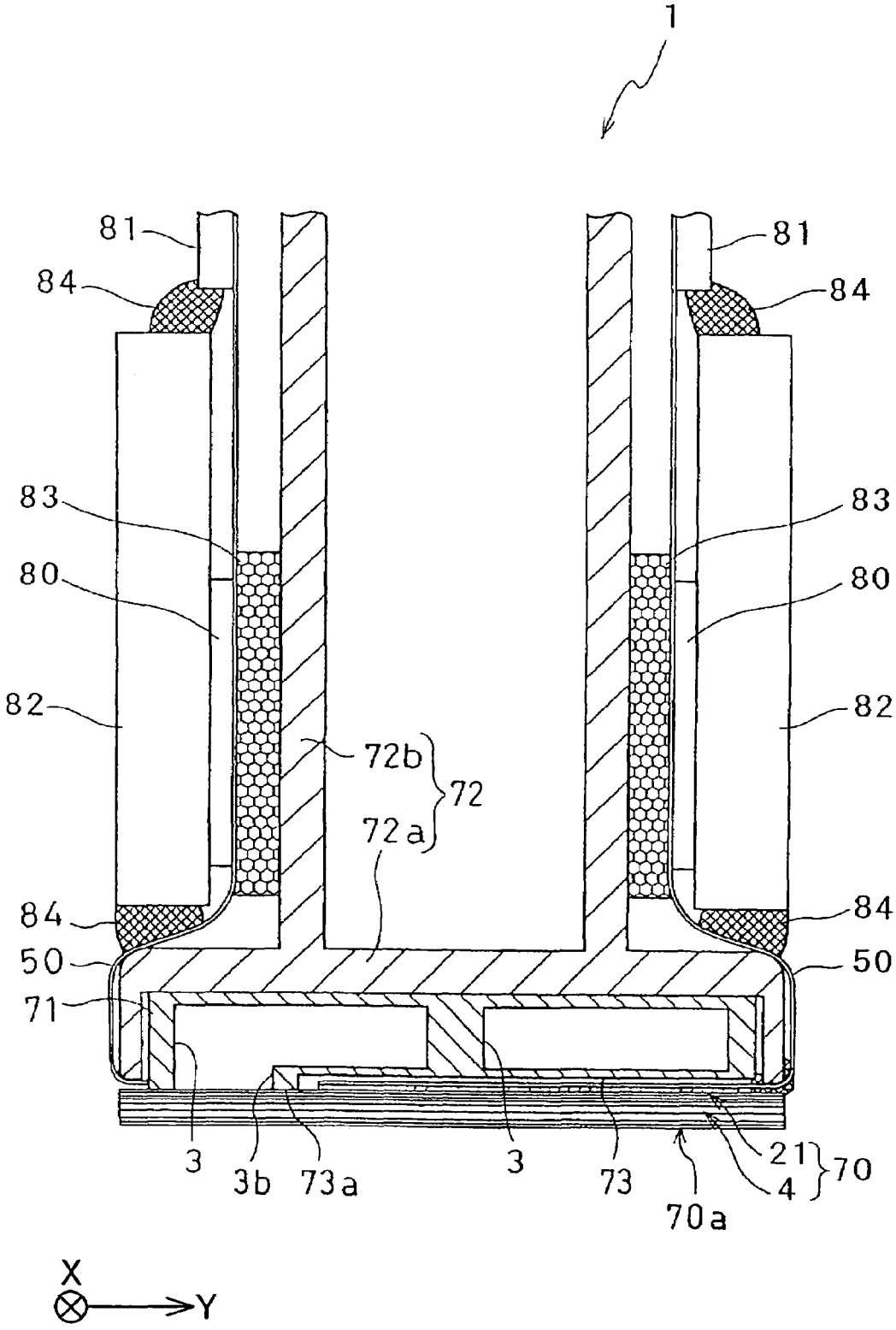
FIG. 2 is a cross-sectional diagram along the line II-II shown in FIG. 1.

An inkjet head according to a first embodiment of the present invention will be described. FIG. 1 is an external perspective view of an inkjet head assembly 1 of the first embodiment of the present invention. FIG. 2 is a cross-sectional diagram along the line II-II shown in FIG. 1. As shown in FIG. 1, inkjet head assembly 1 includes inkjet head 70, having a planar shape of a rectangle long in the main scanning direction X, for discharging ink on a printing sheet. Inkjet head assembly 1 also includes base block 71 and holder 72. Base block 71 includes ink storage 3 and is disposed on an upper surface of inkjet head 70, and holder 72 supports inkjet head 70 and base block 71.

Figure 3:
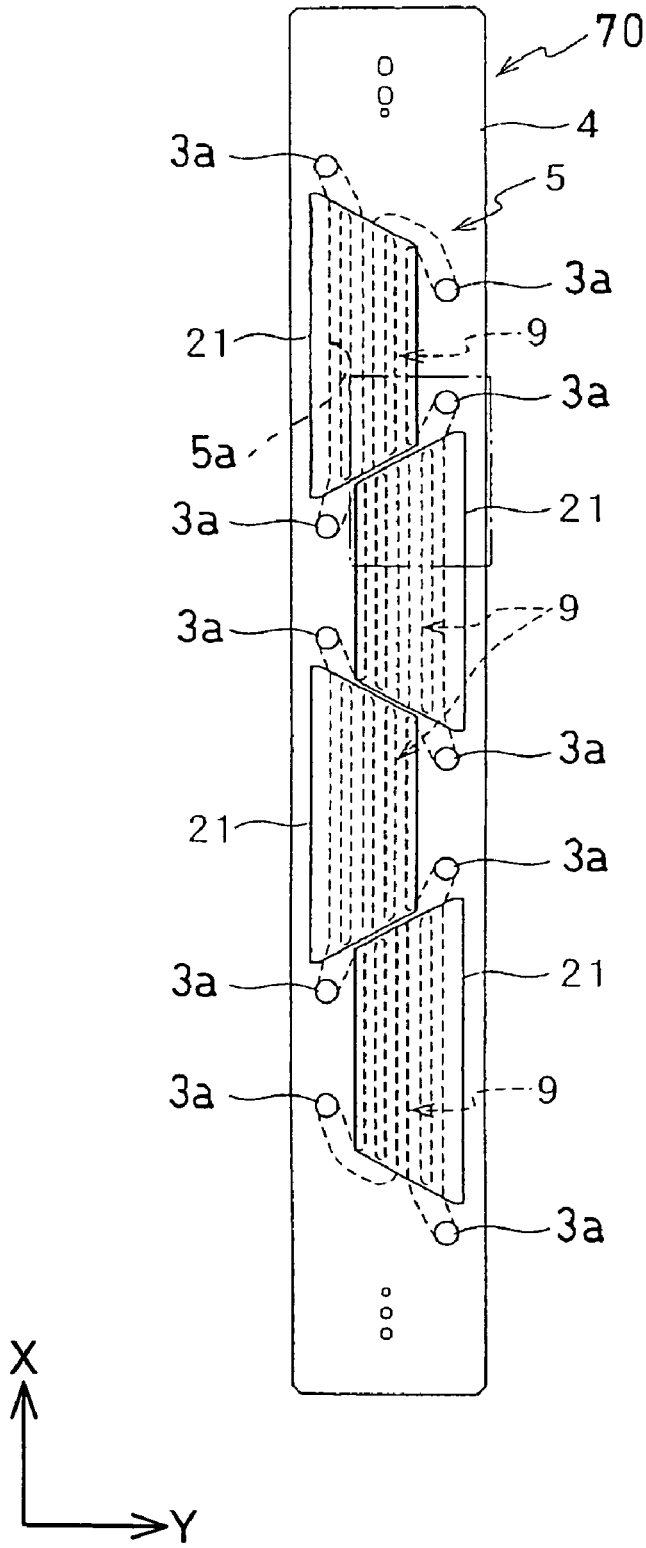
FIG. 3 is a planar diagram viewed from an upper surface of an inkjet head shown in FIG. 2.
Figure 5:
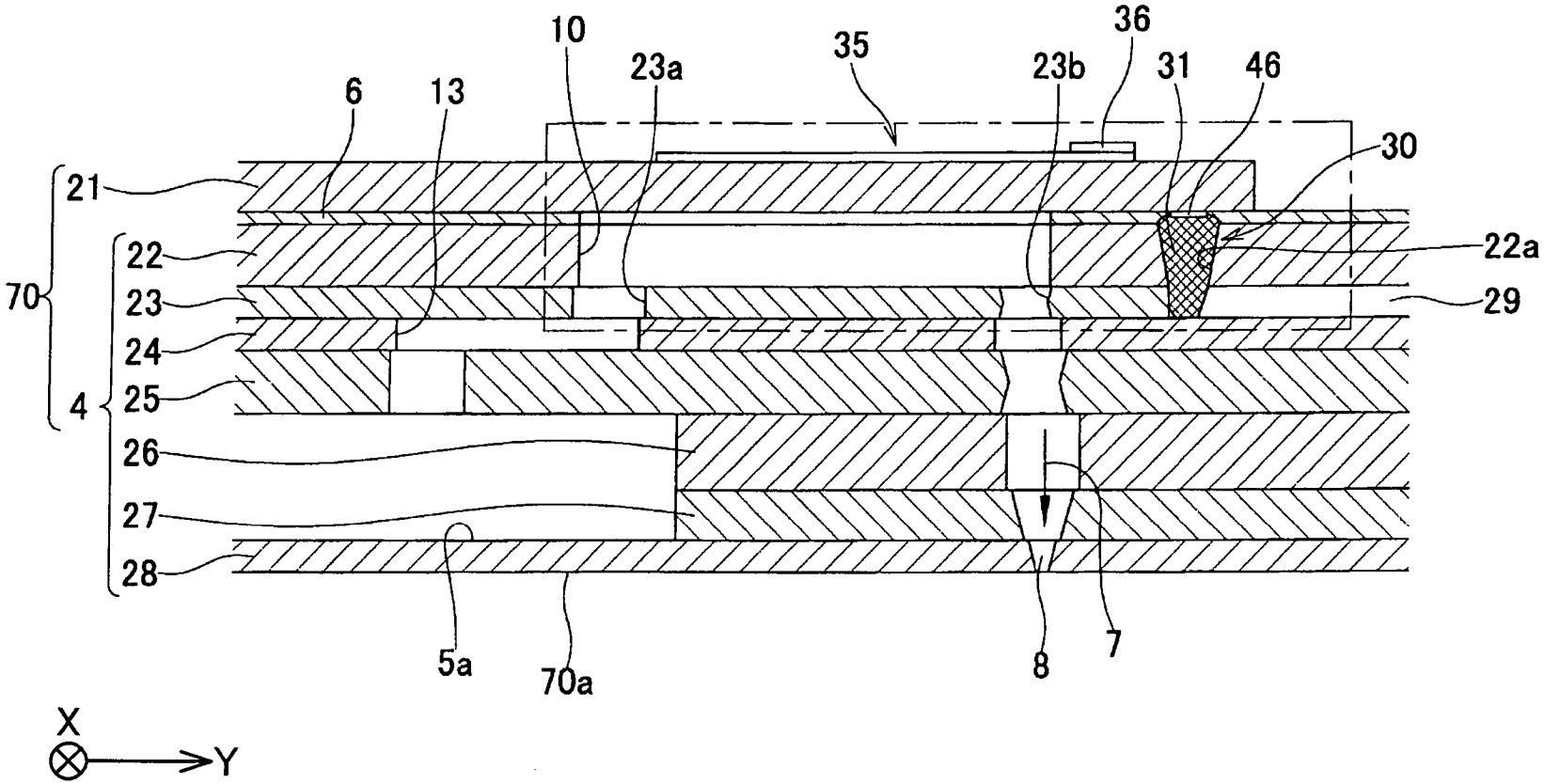
FIG. 5 is a cross-sectional diagram along the line V-V shown in FIG. 4.

As shown in FIG. 2 and FIG. 3, inkjet head 70 includes flow channel unit 4, which has a plurality of ink flow channels, and four actuator units 21, which are attached to the upper surface of flow channel unit 4 by epoxy-based thermosetting adhesive 6 (refer to FIG. 5). Actuator unit 21 is constructed by stacking a plurality of thin boards on top of one another. Further, a bottom surface of inkjet head 70 is ink discharging surface 70*a*, which has a plurality of nozzles 8 (refer to FIG. 5) of minute diameter. Further, as shown in FIG. 2, FPC (Flexible Printed Circuit) 50, which is a feeding member, is attached on an upper surface of actuator unit 21 by soldering, and extends out to the left or to the right.

FIG. 3 is a planar diagram of inkjet head 70 viewed from the top. As shown in FIG. 3, flow channel unit 4 has a planar shape of a rectangle, long in the main scanning direction X. In FIG. 3, manifold flow channel 5, which is a common ink chamber built within flow channel unit 4, is drawn with broken lines. Ink stored in ink storage 3 of base block 71 is supplied to manifold flow channel 5 through a plurality of openings 3*a*. Manifold flow channel 5 diverges into a plurality of sub-manifold flow channels 5*a* extending parallel to the longitudinal direction (main scanning direction X) of flow channel unit 4.

Four actuator units 21, each having a planar shape of a trapezoid, are arranged in two rows and attached on the upper surface of flow channel unit 4 in a zigzag pattern so as not overlap with openings 3*a*. Each actuator unit 21 is disposed so that parallel sides (top side and bottom side) of each actuator unit 21 lie along a longitudinal direction X of flow channel 4. The plurality of openings 3*a* is also arranged in two rows, each row having five openings, along the longitudinal direction X of flow channel unit 4. In total, there are 10 openings 3*a*, all formed at positions where openings 3*a* will not interfere with actuator unit 21. Further, slanted sides of adjacent actuator units 21 partially overlap along a width direction (sub-scanning direction Y) of flow channel unit 4.

As shown in FIG. 5, a bottom surface of flow channel unit 4 is ink discharging surface 70*a*. A plurality of nozzles 8 is arranged in a matrix pattern in an ink discharging region that corresponds a region where four actuator units 21 are attached to the top surface of flow channel unit 4. As shown in FIG. 3, pressure chamber group 9, comprising a plurality of pressure chambers 10 (refer to FIG. 5) is also arranged in a matrix pattern in the ink discharging region that corresponds the region where four actuator units 21 are attached to the top surface of flow channel unit 4. In other words, each actuator unit 21 is configured to span over the plurality of pressure chambers 10 which compose pressure chamber group 9.

Referring back to FIG. 2, base block 71 is made of metallic material such as stainless steel. Ink storage 3 within base block 71 is a hollow region having an approximate shape of a rectangle extending in the longitudinal direction X of base block 71. Through an opening (not shown) formed on one end of ink storage 3, ink is supplied to ink storage 3 from an ink tank (not shown) installed on the exterior of inkjet head assembly 1, and ink storage 3 is always filled with ink. A total of 10 openings 3*b* through which the ink flows is formed on ink storage 3 in two rows, along the extended direction. These openings 3*b* are formed in a zigzag pattern so as to communicate with openings 3*a* of flow channel unit 4. In other words, 10 openings 3*b* on ink storage 3 and 10 openings 3*a* on flow channel unit 4 are formed with the same positional relationship.

Bottom surface 73 of base block 71 protrudes downward at proximity sections 73*a* of openings 3*b*. Further, base block 71 contacts proximity sections of openings 3*a* on the upper surface of flow channel unit 4 only at proximity sections 73*a* of openings 3*b* on bottom surface 73. Therefore, except for proximity sections 73*a* of openings 3*b* on bottom surface 73 of base block 73, a region of bottom surface 73 is separated from inkjet head 70, and actuator units 21 are disposed in that separated region.

Holder 72 includes gripper 72*a*, which grips base block 71, and a pair of protrusions 72*b*, which protrudes upward from an upper surface of gripper 72*a*. The pair of protrusions 72*b* is formed with a distance between them in the sub scanning direction. Base block 71 is attached and fixed at a cavity formed on a bottom surface of gripper 72*a* of holder 72. FPCs 50, connected to the top surfaces of actuator units 21, are each disposed along a surface of protrusion 72*b* of holder 72 via elastic member 83 such as a sponge. Further, driver IC 80 is installed on FPC 50 disposed on the surface of protrusion 72*b* of holder 72. In other words, FPC 50 transmits a driving signal outputted from driver IC 80 to actuator unit 21 of inkjet head 70. FPC 50 electrically connects actuator unit 21 and driver IC 80.

Heat generated from driver IC 80 can be efficiently dissipated because heat sink 82, shaped approximately as a rectangular parallelepiped, is attached to an outer surface of driver IC 80. Board 81, connected to an outer side of FPC 50, is disposed above driver IC 80 and heat sink 82. Sealing member 84 is attached between an upper surface of heat sink 82 and board 81, and also between a bottom surface of heat sink 82 and FPC 50. This can prevent dust and ink from entering inkjet head assembly 1.

Figure 4:
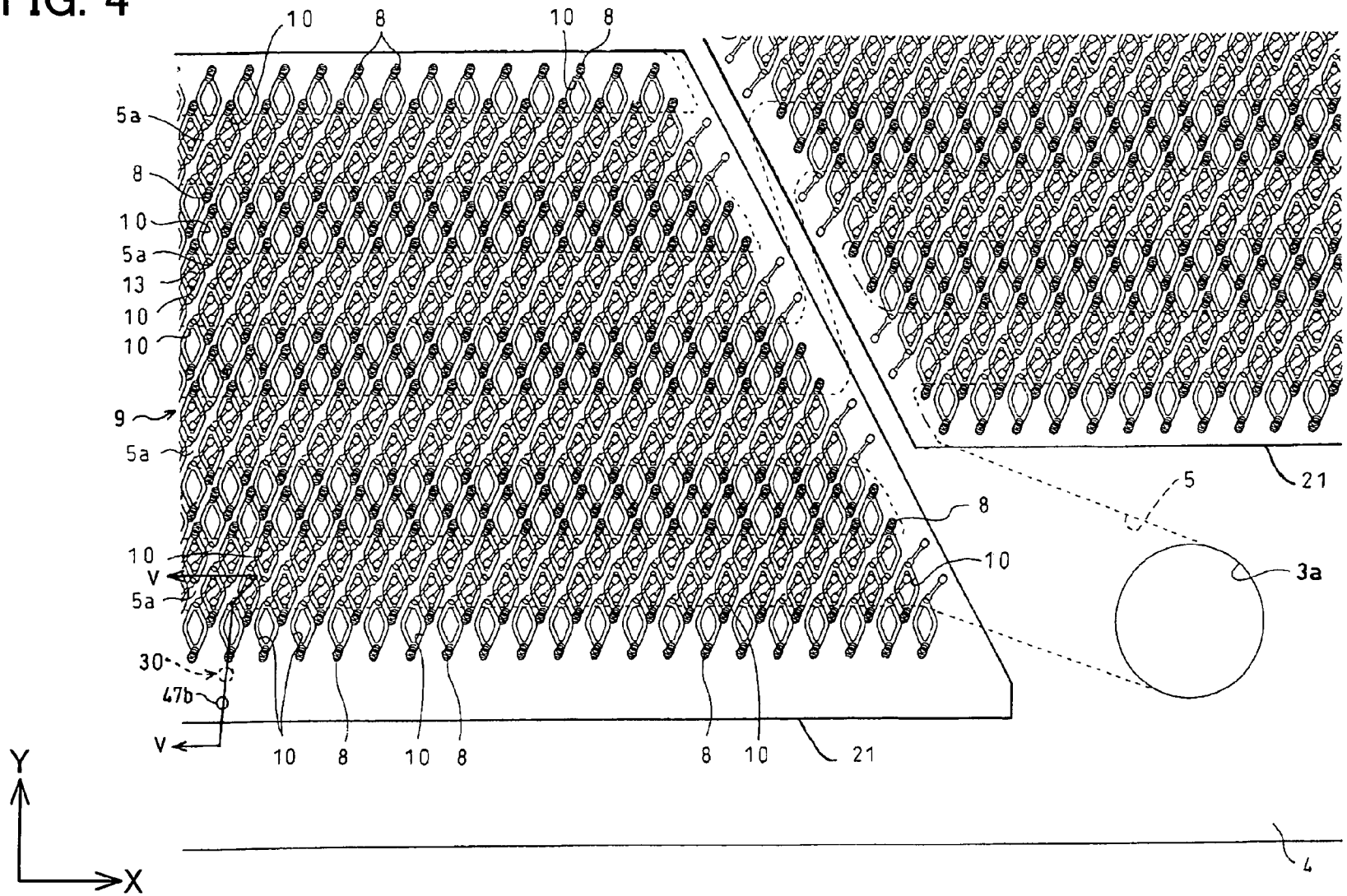
FIG. 4 is an enlarged planar diagram of a region framed by the dashed lines shown in FIG. 3.

FIG. 4 is an enlarged planar diagram of the region framed by the dashed lines illustrated in FIG. 3. As shown in FIG. 4, in a region within flow channel unit 4 that faces actuator unit 21, four sub-manifold flow channel 5*a* extend parallel to the longitudinal direction X of flow channel unit 4. A plurality of individual ink flow channels 7 (refer to FIG. 5) is connected to sub-manifold flow channel 5*a*, wherein each individual ink flow channel 7 is connected to one nozzle 8.

Pressure chamber group 9 comprising a plurality of pressure chambers 10 is formed on a region on the upper surface of flow channel unit 4 that faces actuator unit 21. Pressure chambers 10 are arranged in a matrix pattern that has the similar pattern as of the matrix pattern of nozzles 8. Pressure chamber 10 has a planar shape of approximately a rhombus, and pressure chamber group 9 is shaped as a trapezoid with approximately the same size dimension as the outer shape of actuator unit 21. One pressure chamber group 9 is formed for each actuator unit 21. An acute-angle section of each pressure chamber 10 of pressure chamber group 9 is connected to one corresponding nozzle 8, via one corresponding ink flow channel 7 (see FIG. 5). Further, the other acute-angle section of each pressure chamber 10 is connected to sub-manifold flow channel 5*a*, via aperture 13. As will be described below, individual electrodes 35 (refer to FIG. 6), each being slightly smaller than pressure chamber 10, are arranged in a matrix pattern on actuator unit 21 so as to face pressure chambers 10. The matrix pattern of individual electrodes 35 has the same pattern as of the matrix pattern of pressure chambers.

Further, cavity 30 is formed on the upper surface of flow channel unit 4 which faces actuator unit 21 at a position outside of pressure chamber group 9. Referring to FIG. 4, aperture 13, nozzles 8, and pressure chambers 10 (pressure chamber group 9) disposed below actuator unit 21 should have been drawn with broken lines, but they were instead drawn with solid lines to render the diagram easier to understand.

Next, a cross-sectional structure of inkjet head 70 will be explained. FIG. 5 is a cross-sectional diagram along line V-V shown in FIG. 4, and illustrates individual ink flow channel 7. As shown in FIG. 5, nozzle 8 is connected to sub-manifold flow channel 5*a* via pressure chamber 10 and aperture 13. Accordingly, individual ink flow channel 7, which reaches nozzle 8 from an outlet of sub-manifold flow channel 5*a* through aperture 13 and pressure chamber 10, is formed within inkjet head 70 for each pressure chamber 10.

As shown in FIG. 5, inkjet head 70 has a laminated structure with a total of eight plates stacked on top of one another. From top to bottom, the stacked plates consist of actuator unit 21, cavity plate 22, base plate 23, aperture plate 24, supply plate 25, manifold plates 26 and 27, and nozzle plate 28. Flow channel unit 4 is constructed by seven of these plates, excluding actuator unit 21.

Figure 6:
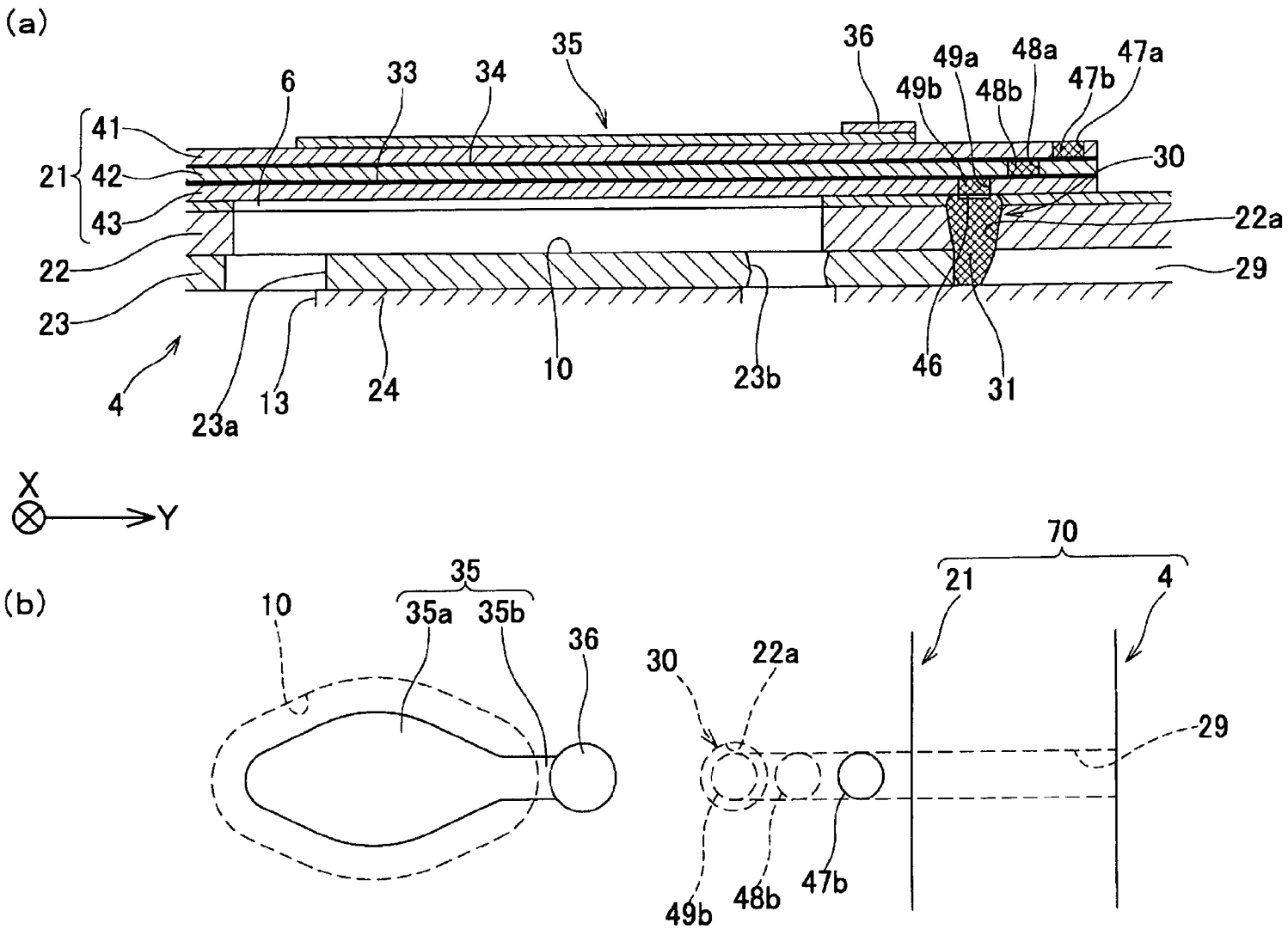
FIG. 6(*a*) is an enlarged cross-sectional diagram of a portion of a region framed by the dotted lines shown in FIG. 5, and FIG. 6(*b*) is an enlarged planar diagram of a portion of an actuator unit.

As shown in FIG. 6, actuator unit 21 comprises three piezoelectric sheets 41-43. As will be explained below, by stacking three piezoelectric sheets 41-43 and disposing common electrode between the uppermost layer 41 and second layer 42, only the uppermost layer 41 becomes an active layer to which an electric field is applied. The remaining two layers 42, 43 become inactive layers and do not have active portions.

As shown in FIG. 5, cavity plate 22 is a metallic plate with a large number of approximately rhomboid-shaped holes formed within the ink discharging region that corresponds the region where four actuator units 21 are attached to cavity plate 22. Actuator unit 21 caps each rhomboid-shaped hole, and the capped rhomboid-shaped hole forms pressure chamber 10. Besides the rhomboid-shaped hole, hole 22*a* is formed on cavity plate 22. Hole 22*a* is formed at a location where actuator unit 21 is attached but outside of pressure chamber group 9. Hole 22*a* penetrates cavity plate 22.

Base plate 23 is a metallic plate, and for each pressure chamber 10 of cavity plate 22, base plate 23 has connecting hole 23*a*, which connects pressure chamber 10 and aperture 13, and connecting hole 23*b*, which connects pressure chamber 10 to nozzle 8. Notch 29 extending along a sub scanning direction Y from a position that faces hole 22*a* of cavity plate 22 is formed on base plate 23. Notch 29 is formed to penetrate base plate 23 in a thick direction. According to this configuration, cavity 30 and a connection passage are formed on flow channel unit 4 by stacking cavity plate 22, base plate 23, and aperture plate 24. Cavity 30 is formed by hole 22*a*, and the connection passage is formed by notch 29, a bottom surface of cavity plate 22, and an upper surface of aperture plate 24. Cavity 30 opens up toward actuator unit 21 (in actuality, the opening is covered by actuator unit 21).

As will be explained below, the connection passage enables cavity 30 to connect to the outside when manufacturing inkjet head 70, and is sealed by disposing a sealing material (not shown) on an outlet (opening) of the connection passage once the manufacturing of inkjet head 70 is completed. Conductive member (conductive material) 31 to be used as conductive paste is filled within cavity 30, and contacts terminal (contact terminal) 46 of actuator unit 21, to be described hereinafter. As a result, flow channel unit 4 and contact terminal 46 become electrically connected.

Aperture plate 24 is a metallic plate that has, for each pressure chamber 10 of cavity plate 22, a hole to become aperture 13 and a connecting hole to connect pressure chamber 10 to nozzle 8. Supply plate 25 is a metallic plate that has, for each pressure chamber 10 of cavity plate 22, a connecting hole that connects aperture 13 to sub-manifold flow channel 5*a* and another connecting hole that connects pressure chamber 10 to nozzle 8. Manifold plates 26 and 27 are metallic plates that have, for each pressure chamber 10 of cavity plate 22, sub-manifold flow channel 5*a* and a connecting hole to connect pressure chamber 10 to nozzle 8. Nozzle plate 28 is a metallic plate that has nozzle 8 for each pressure chamber 10 of cavity plate 22.

Seven metallic plates 22 to 28 are bonded by electro conductive adhesive so that the whole flow channel unit 4 becomes a block of conductive material.

These eight plates 21-28 are each stacked in a certain alignment so as to form individual ink flow channel 7, as shown in FIG. 5. Individual ink flow channel 7 first proceeds upward from sub-manifold flow channel Sa, extends horizontally at aperture 13, proceeds further upward, extends horizontally at pressure chamber 10, proceeds downward in a slightly slanted direction away from aperture 13, and then proceeds vertically downward toward nozzle 8.

As is obvious from FIG. 5, pressure chamber 10 and aperture 13 are formed at different levels with respect to the stacked direction of each plate. Accordingly, within flow channel unit 4 facing actuator unit 21, it is possible to dispose aperture 13, which is connected to pressure chamber 10, at a same planar-view position as a neighboring pressure chamber 10, as shown in FIG. 4. As a result, since pressure chambers 10 are very tightly and densely disposed with respect to one another, high-resolution image printing can be performed by inkjet head assembly 1, which has a relatively small area. In addition, by the connection passage created by notch 29 formed on base plate 23, a bottom section of cavity 30 formed on cavity plate 22 can be connected to the outside. Accordingly, when heat processing is applied to the conductive paste that is to fill cavity 30, solvent gas generated from the conductive paste can be released to the outside through the connection passage. This can prevent unwanted pressure from building inside cavity 30, and an optimal attachment can be made at least between each of the plates that make up cavity 30.

Next, a configuration of actuator unit 21 will be explained. FIG. 6 (*a*) is an enlarged cross-sectional diagram of the region framed by the dashed lines in FIG. 5, and FIG. 6 (*b*) is an enlarged planar diagram of a portion of actuator unit 21.

As shown in FIG. 6 (*a*), actuator unit 21 consists of three piezoelectric sheets 41, 42, and 43, each sheet being approximately 15 μm thick and each having the same construction. Piezoelectric sheets 41-43 are flat-plates stacked on top of one another and disposed to straddle the large number of pressure chambers 10, which compose pressure chamber group 9. With piezoelectric sheets 41-43 being disposed as stacked flat-plates that span across the large number of pressure chambers 10, it becomes possible to dispose individual electrodes 35 very densely on piezoelectric sheet 41 using, for example, screen printing technology. Therefore, it also becomes possible to densely dispose pressure chambers 10, which are formed to have the same positional relationship as individual electrodes 35. As a result, high-resolution images can be printed. Piezoelectric sheets 41-43 are made of ceramic material such as titanic acid lead zirconate (PZT), which has ferroelectric properties.

Individual electrodes 35 are formed on a top surface of the uppermost layer, piezoelectric sheet 41. Common electrode 34, formed over an entire surface and having an approximate thickness of 2 μm, is interposed between piezoelectric sheet 41 and piezoelectric sheet 42 disposed below. Similar to common electrode 34, reinforcement electrode 33, formed over an entire surface and having an approximate thickness of 2 μm, is interposed between piezoelectric sheet 42 and the bottommost layer, piezoelectric sheet 43. Individual electrodes 35, common electrode 34, and reinforcement electrode 33 are all made from metallic materials such as Ag-Pd. Further, a side end surface on one side of common electrode 34 and reinforcement electrode 33 becomes exposed when each sheet is stacked. This is because common electrode 34 and reinforcement electrode 33 are formed over an entire surface of piezoelectric sheets 42 and 43, respectively.

As shown in FIG. 6 (*b*), individual electrode 35 comprises main electrode region 35*a* and auxiliary electrode region 35*b*. Main electrode 35*a* is disposed at a position that faces pressure chamber 10, and auxiliary electrode region 35*b* is connected to main electrode 35*a* and is disposed at a position that does not face pressure chamber 10. Main electrode 35*a* has a planar shape of approximately a rhombus that is approximately congruent to pressure chamber 10. An acute angle section of the rhomboid-shaped main electrode 35*a* extends outward and is connected to auxiliary electrode region 35*b*. Land 36, which is circular, is installed on a leading surface of auxiliary electrode region 35*b*. As shown in FIG. 6 (*b*), land 36 faces a region where pressure chamber 10 is not formed on cavity plate 22. Land 36 is made of, for example, metal including glass flit, and is attached and electrically connected to auxiliary electrode region 35*b*. FIG. 6 (*a*) simplifies the illustration of FPC 50, but land 36 is electrically coupled to each of a plurality of contact points on FPC 50.

Holes 47*a*-49*a* are formed on each of piezoelectric sheets 41-43, each hole penetrating one of the sheets in a thick direction so as not to overlap with one another. Conductive wirings 47*b*-49*b* made of conductive material are disposed within holes 47*a*-49*a*. An upper surface of conductive wiring 47*b* is exposed at the upper surface of actuator unit 21 and is connected by soldering to an independent contact point on FPC 50. Conductive wiring 47*b* is connected to ground through FPC 50. On the other hand, a bottom surface of conductive wiring 47*b* is electrically connected to common electrode 34. An upper surface of conductive wiring 48*b* is electrically connected to common electrode 34 and a bottom surface of conductive wiring 48*b* is electrically connected to reinforcement electrode 33. An upper surface of conductive wiring 49*b* is electrically connected to reinforcement electrode 33, and a bottom surface of conductive wiring 49*b* is exposed at the bottom surface of actuator unit 21. That exposed portion of conductive wiring 49*b* is contact terminal 46, which was described above. According to this configuration, flow channel unit 4 is maintained at ground potential because flow channel unit 4 is connected to ground through contact terminal 46, conductive wiring 49*b*, reinforcement electrode 33, conductive wiring 48*b*, common electrode 34, conductive wiring 47*b*, and FPC 50. Also, common electrode 34 and reinforcement electrode 33 are equally maintained at ground potential. In other words, this configuration is such that it produces no difference in electrical potential between flow channel unit 4 and actuator unit 21.

Further, land 36 of individual electrode 35 is joined independently to a contact point on FPC 50, and each land 36 is connected to driver IC 80 independently from other lands. As a result, electrical potential can be controlled independently for each actuator that corresponds to each pressure chamber 10.

Next, a method of driving actuator unit 21 will be explained. The polarization direction of piezoelectric sheet 41 of actuator unit 21 is in the thick direction. In other words, actuator unit 21 is of a so-called unimorph construction having one top side (that is, away from pressure chamber 10) piezoelectric sheet 41 as an active layer and two bottom side (that is, cross to pressure chamber 10) piezoelectric sheets 42 and 43 as inactive layers. Therefore, if an individual electrode 35 is activated and given a predetermined potential of either positive or negative, electric field is grown along the polarization direction of the active piezoelectric sheet 41 at a portion interposed between the activated individual electrode 35 and common electrode 34. That portion shrinks in a direction perpendicular to the polarization direction, due to the piezoelectric transversal effect. On the other hand, piezoelectric sheets 42 and 43 do not shrink on their own because they are not influenced by the electric field. Therefore, a difference in distortion arises in the direction perpendicular to the polarization direction between the uppermost layer (piezoelectric sheet 41), and the lower layers (piezoelectric sheets 42 and 43). As a result, piezoelectric sheets 41-43 transform so as to protrude toward the inactive side (unimorph transformation). At this time, as shown in FIG. 6 (*a*), since a bottom surface of piezoelectric sheets 41-43 are fixed on a top surface of cavity plate 22 which separates pressure chambers 10, piezoelectric sheets 41-43 transform to protrude toward a corresponding pressure chamber 10. As a result, the volume of the corresponding pressure chamber 10 decreases, the pressure on the ink increases, and ink is discharged from the corresponding nozzle 8. Then, when individual electrode 35 and common electrode 34 are brought back to equal electrical potential, piezoelectric sheets 41-43 suction ink from the manifold 5 because piezoelectric sheets 41-43 return to their original shapes and the volume of pressure chamber 10 return to the original volume.

In addition, as another method of driving actuator unit 21, individual electrodes 35 and common electrode 34 are initially held at different electrical potentials. Then, every time a discharge request is made, an the individual electrode 35 and common electrode 34 are brought to equal electrical potential, and at a predetermined timing, individual electrode 35 and common electrode 34 are placed back at different electrical potentials. In this case, because piezoelectric sheets 41-43 move back to their original shapes when the individual electrode 35 and common electrode 34 are brought to equal electrical potential, the volume of pressure chamber 10 increases from their original volume (at condition where both electrodes have different electrical potentials), and ink is suctioned into the pressure chambers 10 from the sub-manifold flow channel 5*a*. Then, at the timing when the individual electrode 35 and common electrode 34 are placed back at different electrical potentials, piezoelectric sheets 41-43 transform and protrude towards the pressure chamber 10 side, the pressure on the ink increases due to decreasing volumes of pressure chamber 10, and ink is discharged from nozzle 8.

<A Method of Manufacturing an Inkjet Head>

Figure 7:
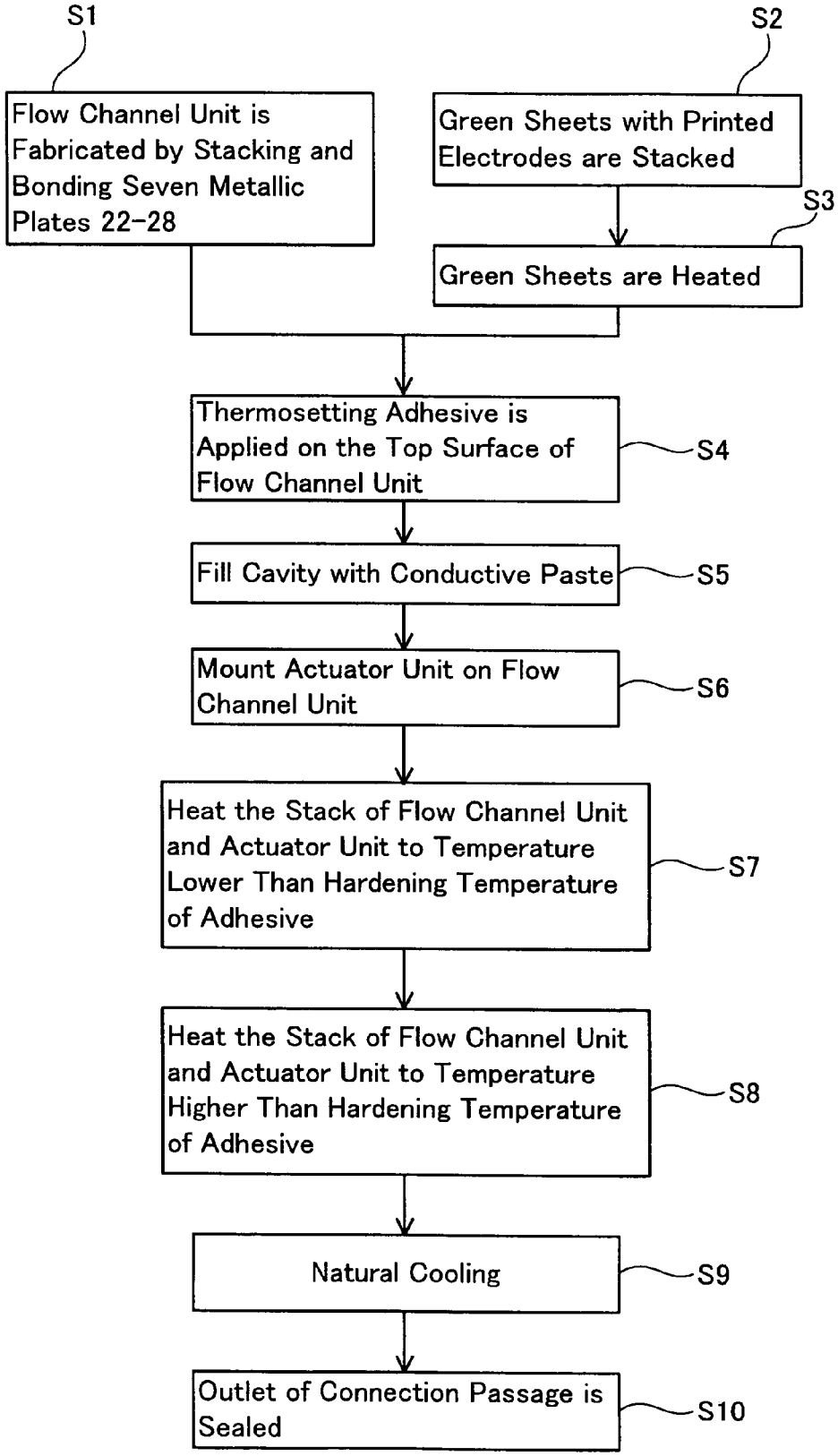
FIG. 7 is a flow chart of the manufacturing steps of the inkjet head.

Next, a method of manufacturing inkjet head will be explained with reference to FIG. 7. FIG. 7 is a flow chart of manufacturing steps of inkjet head.

In order to manufacture inkjet head, components such as flow channel unit 4 and actuator unit 21 are fabricated separately and subsequently combined. First, in step 1 (S1), flow channel unit 4 is fabricated. In order to fabricate flow channel unit 4, holes as shown in FIG. 5 are formed on plates 22-28 by applying etching. The etching has photoresist as a mask, patterned on each of plates 22-28 which compose flow channel unit 4. At this time, hole 22*a* to become cavity 30 is also formed on cavity plate 22. Further, notch 29 is formed on base plate 23. Then, the seven plates 22-28 are layered on top of one another via an epoxy-based electro conductive thermosetting adhesive so that the plates 22-28 align to form a plurality of individual ink flow channels 7 within the flow channel unit 4 and cavity 30 on a flat surface of the flow channel unit 4 to which actuator unit 21 will be attached. Next, pressure and heat are applied to the seven plates 22-28 and the temperature of the plates is raised above a hardening temperature of the thermosetting adhesive. As a result, the thermosetting adhesive hardens, the seven plates 22-28 become fixed to one another, and flow channel unit 4 as shown in FIG. 5 can be attained. In order to avoid interference among flow channel unit 4, actuator unit 21, and contact terminal 46, it is preferable to form hole 22*a* so that an opening area at the top surface of cavity plate 22 is larger than an opening area at the bottom surface. It is also preferable that the opening area of hole 22*a* at the top surface of cavity plate 22 is larger than the contact terminal 46. As a result, when attaching actuator unit 21 with flow channel unit 4, damages or cracks on actuator unit 21 can be prevented.

On the other hand, when fabricating actuator unit 21, three green sheets made of piezoelectric ceramics are prepared in step 2 (S2). The green sheets are formed beforehand with consideration to shrinking that will result from subsequent heating. On the green sheet to become piezoelectric sheet 42, conductive paste is screen printed in a pattern corresponding to common electrode 34. On the green sheet to become piezoelectric sheet 43, conductive paste is screen printed in a pattern corresponding to reinforcement electrode 33. Further, holes 47*a*-49*a* are formed on each of the three green sheets, and conductive paste is filled in each of holes 47*a*-49*a*. Then, while aligning the green sheets with a jig so that holes 47*a*-49*a* do not overlap. The green sheet with the conductive paste screen printed in a pattern corresponding to common electrode 34 is disposed directly below the green sheet without the conductive paste. Further, the green sheet with the conductive paste screen printed in a pattern corresponding to reinforcement electrode 33 is disposed directly below the green sheet with the conductive paste screen printed in the pattern corresponding to common electrode 34.

Then, in step 3 (S3), the laminated body attained in step 2 is degreased in the same way as heretofore known ceramics, and is heated at a predefined temperature. As a result, the three green sheets become piezoelectric sheets 41-43, and the conductive paste becomes common electrode 34, reinforcement electrode 33, and conductive wirings 47*b*-49*b*. Among these, conductive wiring 47*b* becomes a contact terminal, which protrudes from a top surface of piezoelectric sheet 41 and to which FPC 50 is connected. On the other hand, conductive wiring 49*b* becomes contact terminal 46 which protrudes from a bottom surface of piezoelectric sheet 43 to which conductive member 31 contacts. Then, conductive paste is screen printed on top of the uppermost layer, piezoelectric sheet 41, in a pattern corresponding to the plurality of individual electrodes 35. Then, the conductive paste is heated by performing a heating process on the laminated body, and individual electrodes 35 are formed on piezoelectric sheet 41. Land 36 is subsequently formed by printing metal including glass flits on auxiliary electrode region 35*b* of individual electrode 35. At this time, a land identical to land 36 may be formed to electrically connect to the exposed portion of conductive wiring 47*b*. This will enable a more reliable connection between FPC 50 and conductive wiring 47*b*. In this way, actuator unit 21 as shown in FIG. 6 (*a*) can be manufactured.

Step 1 to fabricate flow channel unit 4 and steps 2-3 to fabricate actuator unit 21 are independent of one another. Therefore, either one of step 1 or steps 2-3 can be performed before the other, or they can be carried out simultaneously.

In step 4 (S4), using a bar coater, epoxy-based thermosetting adhesive 6 is applied on a top surface of flow channel unit 4. The top surface of flow channel unit 4 has a plurality of holes for forming pressure chambers and hole 22*a* for forming cavity 30. The adhesive 6 is applied on the top surface of flow channel unit 4 except holes for forming pressure chambers and hole 22*a* for forming cavity 30. A two-component epoxy type, for example, is used as epoxy-based thermosetting adhesive 6.

Next, in step 5 (S5), conductive paste to become conductive member 31 is filled in cavity 30 of flow channel unit 4, which was obtained in step 1. At this time, since a diameter of a bottom side of cavity 30 is smaller than a diameter of an opening at the top side of cavity 30, the conductive paste filled in cavity 30 protrudes above the surface of cavity plate 22, even if with a small amount of the conductive paste. As a result, the conductive paste 31 and contact terminal 46 easily come in contact with one another. In addition, it becomes difficult for epoxy-based thermosetting adhesive 6 to enter between contact terminal 46 and the conductive paste. Therefore, secure contact can be obtained between contact terminal 46 and the conductive paste that will become conductive member 31. This also leads to cost reduction because only a small amount of conductive paste is necessary. Further, in order to avoid an insecure attachment between actuator unit 21 and flow channel unit 4 caused by an excessive amount of conductive paste, it is preferable that the filling amount of the conductive paste be held between 50%-95% of the inside volume of cavity 30.

Next, in step 6 (S6), actuator unit 21 is mounted on flow channel unit 4, which is coated with thermosetting adhesive 6. At this time, each actuator unit 21 is placed in a position on flow channel unit 4 so that each of individual electrode 35 of actuator unit 21 faces a corresponding pressure chamber 10 of flow channel unit 4, and so that contact terminal 46 of actuator unit 21 faces the conductive paste filled in cavity 30 of flow channel unit 4. This position placement is based on a position marker (not shown) formed on flow channel unit 4 and actuator unit 21 during the fabrication steps (steps 1-3).

Next, in step 7 (S7), the laminated body consisting of flow channel unit 4, thermosetting adhesive 6 fixed between flow channel unit 4 and actuator unit 21, and actuator unit 21 is heated with a heating/pressurizing device (not shown) to a temperature no higher than the hardening temperature of thermosetting adhesive 6. By heating the laminated body this way, a part of the solvent of the conductive paste within cavity 30 evaporates. Then, the evaporated gas is released to the outside through a connection passage created by notch 29, which connects cavity 30 to the outside. This can prevent unwanted pressure from building inside cavity 30. Therefore, it becomes possible to attach flow channel unit 4 and actuator unit 21 securely.

Next, in step 8 (S8), pressure is applied to the laminated body as the body is heated above the hardening temperature of thermosetting adhesive 6. In this way, thermosetting adhesive 6 hardens, causing flow channel 4 and actuator unit 21 to become attached. Further, contact terminal 46 and conductive member 31 make secure electrical contact. Then, in step 9 (S9), the laminated body is taken out of the heating/pressurizing device and naturally cooled. Next, in step 10 (S10), an outlet of the connection passage is sealed with a sealing material (not shown), which can prevent ink spew or dust from entering cavity 30 through the connection passage. In this way, inkjet head 70 composed of flow channel unit 4 and actuator unit 21 is manufactured.

Then, after carrying out a connecting step of FPC 50, inkjet head assembly 1 as described above is completed by finishing an attaching step of base block 71.

According to inkjet head assembly 1 of the first embodiment described above, when flow channel unit 4 and actuator unit 21 are attached, the inside of cavity 30 where conductive member 31 is installed does not get covered by thermosetting adhesive 6. Further, since conductive member 31 and contact terminal 46 contact one another, flow channel unit 4 and common electrode 34 of actuator unit 21 can be electrically connected without having to scrape off thermosetting adhesive 6, which covers flow channel unit 4. As a result, a reliable connection between flow channel unit 4 and common electrode 34 of actuator unit 21 can be attained without clogging the ink channel within the flow channel unit 4. Therefore, the potential difference between flow channel unit 4 and common electrode 34 of actuator unit 21 becomes zero, and migration becomes improbable. Further, since a large proportion of conductive wirings 47*b*-49*b* of actuator unit 21 is unexposed to the outside, conductive wirings 47*b*-49*b* can be protected from ink spew and dust. Further, since conductive wirings 47*b*-49*b* are not disposed to overlap with one another, conductive wirings 47*b*-49*b* will not easily come off actuator unit 21 when pressure is applied to actuator unit 21. This is because holes 47*a*-49*a*, in which conductive wirings 47*b*-49*b* are disposed, do not continuously penetrate actuator unit 21 in a direction perpendicular to the attachment surface between actuator unit 21 and flow channel unit 4. Accordingly, even if pressure generated by the contact made between contact terminal 46 and conductive member 31 is applied to conductive wiring 49*b*, piezoelectric sheet 42 is positioned on an upper side of conductive wiring 49*b* so that pressure can be absorbed not only by the force of attachment between conductive wiring 49*b* and hole 49*a*, but also by piezoelectric sheet 42.

In the above embodiment, epoxy-based thermosetting adhesive 6 is not electric conductive. However, flow channel unit 4 and common electrode 34 of actuator unit 21 is securely connected via conductive member 31 and contact terminal 46 and maintained at the same electrical potential. Even if adhesive 6 is electric conductive, still conductive member 31 and contact terminal 46 are useful in making flow channel unit 4 and common electrode 34 of actuator unit 21 at the same electrical potential. When conductive member 31 and contact terminal 46 are not used, it may be possible that flow channel unit 4 and common electrode 34 of actuator unit 21 have different electrical potential due to resistance of adhesive 6. Conductive member 31 and contact terminal 46 have very low resistance, therefore, flow channel unit 4 and common electrode 34 of actuator unit 21 are maintained at the same level accurately.

In the above embodiment, seven plates 22-28 are adhered by electro conductive adhesive to fabricate flow channel unit 4. However, in a case that conductive member 31 is deep enough to connect seven plates 22-28, plates 22-28 may be adhered by non-electro conductive adhesive.

Figure 8:
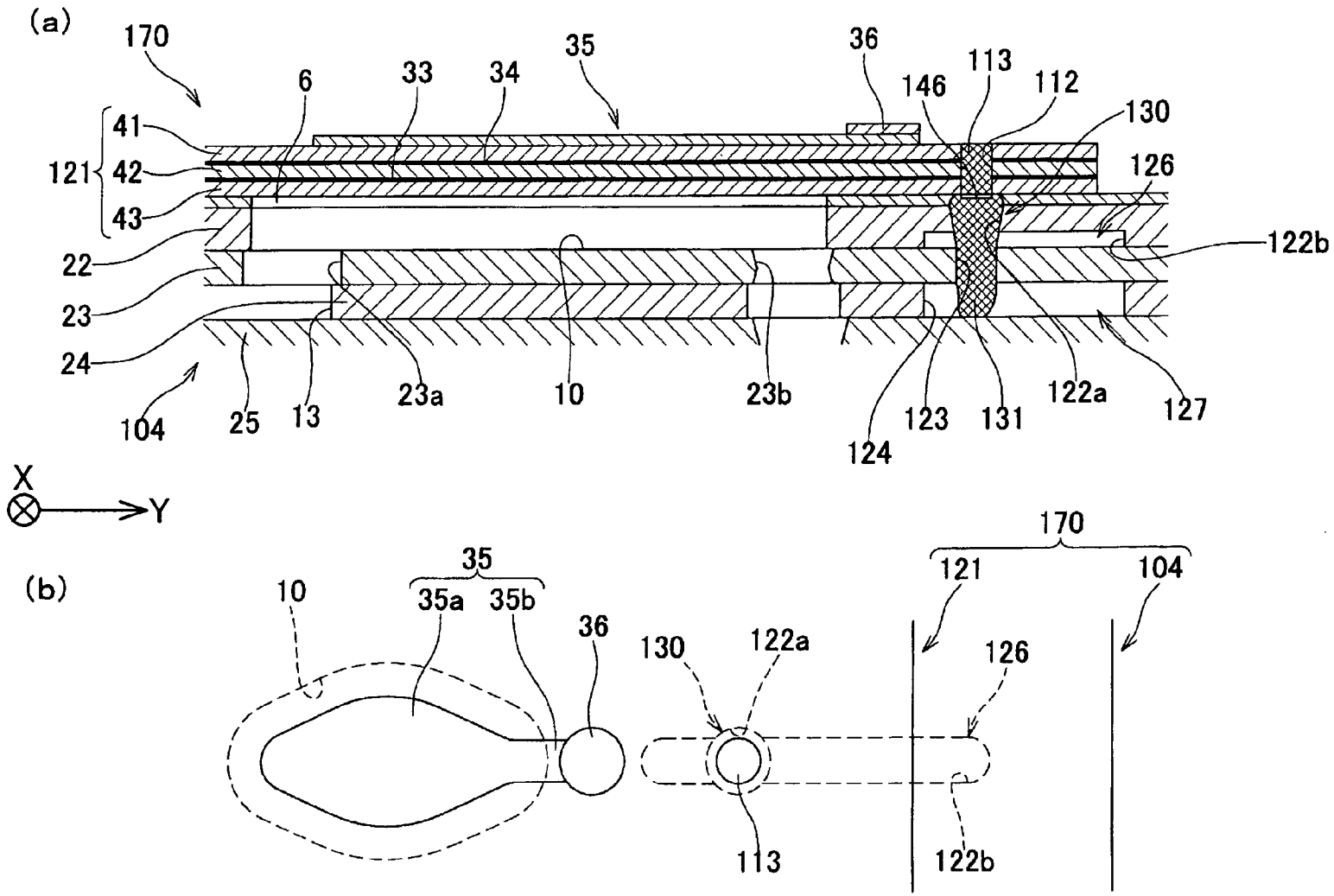
FIG. 8(*a*) is an enlarged cross-sectional diagram of an inkjet head according to a second embodiment of the present invention, and FIG. 8(*b*) is an enlarged planar diagram of a portion of an actuator unit.

Next, an inkjet head 170 according to a second embodiment of the present invention will be described. FIG. 8 (*a*) is an enlarged cross-sectional diagram of a portion of inkjet head 170 according to the second embodiment of the present invention, and FIG. 8 (*b*) is an enlarged planar diagram of a portion of inkjet head 170. Components identical to inkjet head assembly 1 of the first embodiment will be represented with the same notations, and their explanation will be shortened.

Actuator unit 121 of inkjet head 170 according to the present embodiment has hole 112 that continuously penetrates piezoelectric sheets 41-43 in the thick direction, as shown in FIG. 8 (*a*). Hole 112 is formed at a position that faces conductive member 131, and conductive wiring 113 made of conductive material is disposed inside hole 112. Conductive wiring 113 is electrically connected to common electrode 34 and reinforcement electrode 33. An upper surface of conductive wiring 113 is exposed on an upper surface of actuator unit 121, and is connected by soldering to independent connection point (not shown) on FPC 50. Conductive wiring 113 is also connected to ground at the upper surface of conductive wiring 113 via FPC 50. On the other hand, a bottom surface of conductive wiring 113 is exposed at a bottom surface of actuator unit 121, and the exposed section is contact terminal 146. According to this configuration, as was the case with the first embodiment, flow channel unit 104 is maintained at ground potential because common electrode 34 and reinforcement electrode 33 are maintained at ground in a region that corresponds to all pressure chambers 10, and also because contact terminal 146 contacts conductive member 131. In other words, according to this configuration, a difference in electrical potential between flow channel unit 104 and actuator unit 121 does not arise.

Flow channel unit 104 is composed of seven metallic plates stacked on top of one another, as was the case with flow channel unit 4 mentioned above, but cavity plate 22, base plate 23, and aperture plate 24 have slightly different configurations as those of the above-mentioned embodiment. As shown in FIGS. 8 (*a*) and (*b*), in addition to holes to become pressure chambers 10, holes 122*a* and cavity 122*b* are formed on cavity plate 22 of flow channel unit 104. Hole 122*a* penetrates cavity plate 22 in a thick direction at a position that faces contact terminal 146. Cavity 122*b* extends parallel to a sub-scanning direction on a bottom surface that faces base plate 23. Other than connecting holes 23*a* and 23*b*, hole 123 that penetrates base plate 23 in the thick direction is also formed on base plate 23. In addition to aperture 13 and a connecting hole that connects pressure chamber 10 with nozzle 8, hole 124, which penetrates aperture plate 24 in the thick direction at a region that faces cavity 122*b*, is formed on aperture plate 24. By stacking these plates 22-24 and supply plate 25, first spare chamber 126, second spare chamber 127, and cavity 130 are formed within flow channel unit 104. First spare chamber 126 is framed by cavity 122*b* and an upper surface of base plate 23, and second spare chamber 127 is framed by hole 124, a bottom surface of base plate 23, and an upper surface of supply plate 25.

Cavity 130 connects the first and second spare chambers 126 and 127. A conductive paste to become conductive member 131 is filled in cavity 130. Then, as was the case in the first embodiment described above, flow channel unit 104 and actuator unit 121 are attached with thermosetting adhesive 6, and contact terminal 146 of actuator unit 121 contacts conductive member 131. As a result, flow channel unit 104 and contact terminal 146 of actuator unit 121 become electrically connected.

<A Method of Manufacturing an Inkjet Head>

A method of manufacturing inkjet head 170 of the second embodiment described above is nearly equivalent to the method of manufacturing the first embodiment. First, flow channel unit 104 is fabricated. At this time, the method of manufacturing the second embodiment differs in that hole 122*a* and cavity 122*b* are formed on cavity plate 22, hole 123 is formed on base plate 23, and hole 124 is formed on aperture plate 24. These holes 122*a*, 123, and 124 are formed by etching, and cavity 122*b* is formed by half-etching. Then, each plate is stacked on top of one another via the thermosetting adhesive, and the plates are pressurized and heated above a hardening temperature of the thermosetting adhesive. As a result, the thermosetting adhesive hardens, and flow channel unit 104 comprising cavity 130, first spare chamber 126, and second spare chamber 127 can be attained.

Next, actuator unit 121 is fabricated. First, three green sheets made of piezoelectric ceramics are prepared. The green sheets are formed beforehand with consideration to the shrinking that will results from subsequent heating. On the green sheet to become piezoelectric sheet 42, conductive paste is screen printed in a pattern corresponding to common electrode 34. On the green sheet to become piezoelectric sheet 43, conductive paste is screen printed in a pattern corresponding to reinforcement electrode 33. Then, a hole is formed on each of the three green sheets, and each green sheet is positioned to overlap one another and is aligned so that the holes line up to form hole 112. Hole 112 is then filled with conductive paste. Obviously, the hole on each of the three green sheets can be individually filled with the conductive paste prior to stacking the green sheets. Next, the laminated body is degreased in the same way as heretofore known ceramics, and is heated at a predefined temperature. As a result, the three green sheets become piezoelectric sheets 41-43, and the conductive paste becomes common electrode 34, reinforcement electrode 33, and conductive wiring 113. Then, conductive paste is screen printed on top of the uppermost layer, piezoelectric sheet 41, in a pattern corresponding to individual electrodes 35. Then, the conductive paste is heated by performing a heating process on the laminated body, and individual electrodes 35 are formed on piezoelectric sheet 41. Land 36 is subsequently formed by printing metal including glass flits on auxiliary electrode region 35*b* of individual electrode 35. In this way, actuator unit 121 as shown in FIG. 8 (*a*) can be manufactured.

Parenthetically speaking, in order to prevent conductive wiring 113 from coming off actuator unit 121 when connecting conductive wiring 113 and FPC 50, land 36 may be formed in an offset position from an exposed portion of conductive wiring 113, while at the same time electrically connecting a similar land to conductive wiring 113 exposed on a surface of piezoelectric sheet 41. This enables conductive wiring 113 to be placed at ground potential because conductive wiring 113 does not directly receive the pressure produced from connecting FPC 50.

Next, using a bar coater, an epoxy-based thermosetting adhesive is applied on a top surface of flow channel unit 121. Adhesive is applied to the top surface of flow channel unit other than cavity 130 and the plurality of cavities corresponding to the plurality of pressure chambers of flow channel unit 104, as was done in the first embodiment. Then, cavity 130 of flow channel unit 104 is filled with conductive paste, which becomes conductive member 131. At this time, since a diameter of a bottom side of hole 122*a* constituting a portion of cavity 130 is smaller than a diameter of an opening side of hole 122*a*, the conductive paste protrudes above the surface of cavity plate 22.

Next, each actuator unit 121 is mounted on flow channel unit 104. At this time, each actuator unit 121 is placed in position on flow channel unit 104 so that the active layer faces pressure chambers 10 and so that the conductive paste filled in cavity 130 of flow channel unit 104 faces contact terminal 146 of actuator unit 121.

Next, the laminated body consisting of flow channel unit 104, thermosetting adhesive 6 fixed between flow channel unit 104 and actuator unit 121, and actuator unit 121 is heated with a heating/pressurizing device (not shown) to a temperature no higher than the hardening temperature of thermosetting adhesive 6. By heating the laminated body in this way, a part of a solvent of the conductive paste within cavity 130 evaporates, and the evaporated gas is released into the first and second spare chambers 126 and 127. This allows the pressure within cavity 130 to. Therefore, flow channel unit 104 and actuator unit 121 can be securely attached to one another. Then, inkjet head 170 is manufactured by heating the laminated body above a hardening temperature of thermosetting adhesive 6 and then naturally cooling it, as was done in the first embodiment. Finally, after carrying out a connecting step of FPC 50, the inkjet head as described above is completed by finishing an attachment step of base block 71. With the present embodiment, since excess conductive paste can also be released into the first and second spare chambers 126 and 127, the attachment between each plate does not get adversely affected even if the conductive paste overflows.

Not only is inkjet head 170 of the above-mentioned second embodiment able to attain all the effects attained by inkjet head assembly 1 of the first embodiment, but also inkjet head 170 of the second embodiment can also electrically connect common electrode 34, reinforcement electrode 33, and terminal 146 all at once. This is possible because the inkjet head 170 of the second embodiment bears conductive wiring 113 within hole 112, which penetrates actuator unit 121. Further, with respect to the method of manufacturing, conductive wiring 113, which electrically connects contact terminal 146 to common electrode 34 and reinforcement electrode 33, can be easily formed by filling hole 112 with the conductive paste to become conductive wiring 113 and heating the conductive paste.

Figure 9:
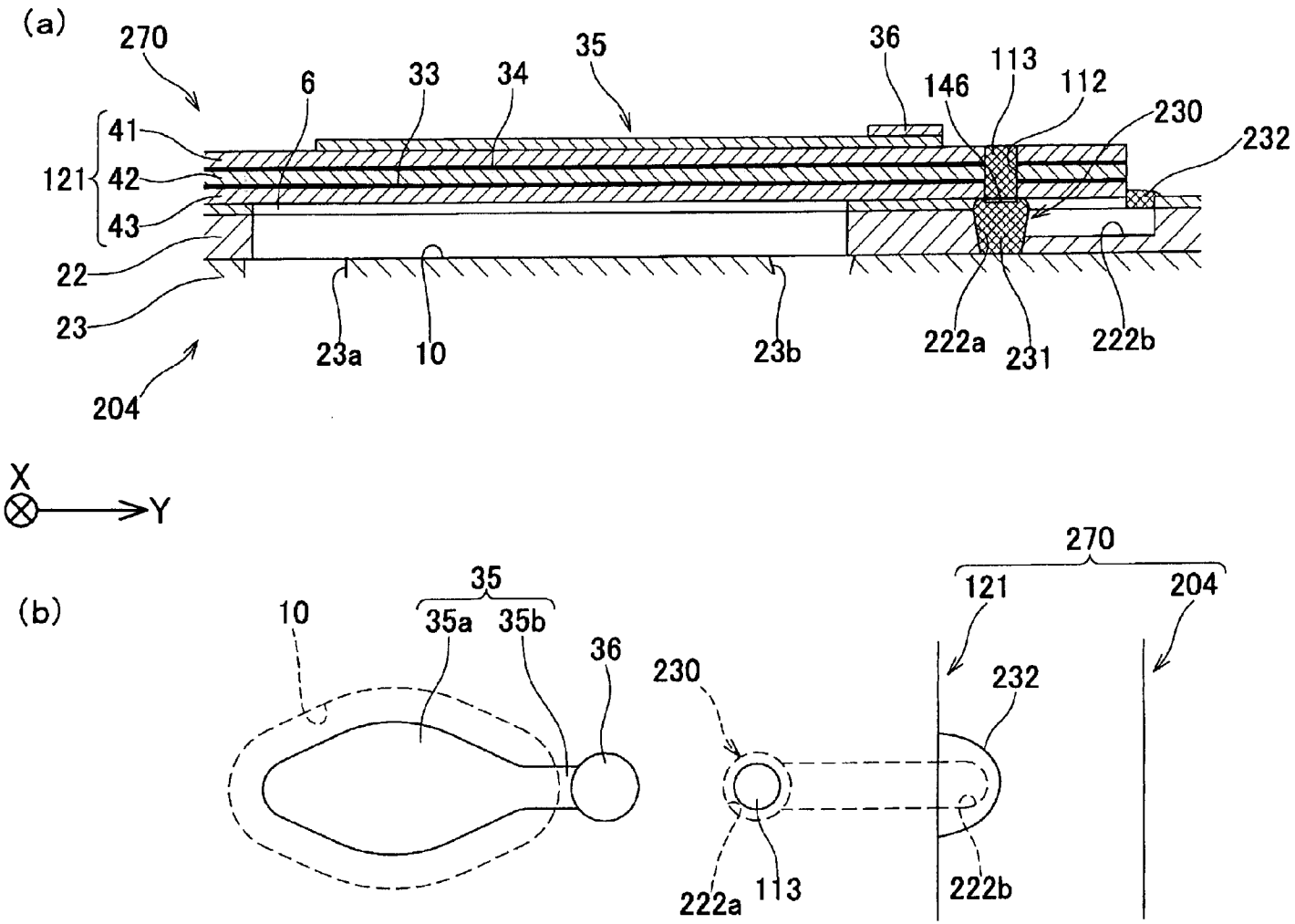
FIG. 9(*a*) is an enlarged cross-sectional diagram of an inkjet head according to a third embodiment of the present invention, and FIG. 9(*b*) is an enlarged planar diagram of a portion of an actuator unit.

Next, an inkjet head 270 according to a third embodiment of the present invention will be described. FIG. 9 (*a*) is an enlarged cross-sectional diagram of inkjet head 270 according to the third embodiment of the present invention, and FIG. 9 (*b*) is an enlarged planar diagram of a portion of inkjet head 270. Components identical to the inkjet heads of the first and second embodiments will be represented with the same notations, and their explanation will be shortened.

The inkjet head of the present embodiment is similar to the inkjet head of the second embodiment with the exception that a configuration of flow channel unit 204 is slightly different than the configuration of flow channel unit 104. As shown in FIGS. 9 (*a*) and FIGS. 9 (*b*), in addition to holes to become pressure chambers 10, holes 222*a* and groove 222*b* are formed on cavity plate 22 of flow channel unit 204. Hole 222*a* penetrates cavity plate 22 in a thick direction at a position that faces contact terminal 146. Groove 222*b* extends parallel to a sub-scanning direction Y on a top surface of cavity plate 22 that faces actuator unit 121. Groove 222*b* extends from hole 222*a* and reaches a region that does not face actuator unit 121, and opens toward the actuator unit 121 side. Only connecting holes 23*a* and 23*b* are formed on base plate 23. By stacking actuator unit 121, cavity plate 22, and base plate 23, a connection passage and cavity 230 connecting to that connection passage are formed on flow channel unit 204. The connection passage is framed by a bottom surface of actuator unit 121 and groove 222*b*, and is connected to the outside. Sealing material 232 is disposed on an outlet of the connection passage, preventing ink spew and dust from entering cavity 230 through the connection passage. Cavity 230 is filled with conductive paste to become conductive member 231. Then, similarly to the first and second embodiments described above, flow channel unit 204 and actuator unit 121 are attached with thermosetting adhesive 6, and contact terminal 146 of actuator unit 121 contacts conductive member 231. As a result, flow channel unit 204 and terminal 146 become electrically connected.

<A Method of Manufacturing an Inkjet Head>

In a method of manufacturing inkjet head 270 of the third embodiment mentioned above, flow channel unit 204 is first fabricated as was done in the first and second embodiments. At this time, the method of manufacturing the third embodiment differs in that hole 222*a* and groove 222*b* are formed on cavity plate 22. The holes to become pressure chambers 10 and hole 222*a* are formed by etching, and groove 222*b* is formed by half-etching. Holes are also formed on the plates other than cavity plate 22, by etching. Then, each plate is stacked on top of one another via a thermosetting adhesive, and pressure is applied to the laminated body while the body is heated above the hardening temperature of thermosetting adhesive 6. As a result, the thermosetting adhesive hardens, and flow channel unit 204 can be attained with groove 222*b* and cavity 230 formed on a top surface that faces actuator unit 121 of flow channel unit 204.

Next, actuator unit 121 is fabricated in a similar fashion as the second embodiment. Using a bar coater, an epoxy-based thermosetting adhesive is applied on the top surface of flow channel unit 204, as was done with the above-mentioned embodiments. Then, cavity 230 of flow channel unit 204 is filled with conductive paste to become conductive member 231. Then, each actuator unit 121 is mounted on flow channel unit 204. At this time, each actuator unit 121 is positioned on flow channel unit 204 so that an active layer faces the pressure chambers region, and so that the conductive paste filled in cavity 230 of flow channel unit 204 faces contact terminal 146 of actuator unit 121.

Next, the laminated body consisting of flow channel unit 204, thermosetting adhesive 6 fixed between flow channel unit 204 and actuator unit 121, and actuator unit 121 is heated with a heating/pressurizing device (not shown) to a temperature no higher than the hardening temperature of thermosetting adhesive 6. By heating the laminated body in this way, a part of a solvent of the conductive paste within cavity 230 evaporates, and the evaporated gas is released to the outside through a connection passage framed by groove 222*b* and a bottom surface of actuator unit 121. As was the case with the first embodiment, this enables secure attachment between flow channel 204 and actuator unit 121. Then, as was done in the first embodiment, the laminated body is further heated and then naturally cooled. Then, an outlet of the connection passage is sealed with sealing material 232. This can prevent ink spew and dust from entering cavity 230 through the connection passage. In this way, inkjet head 270 comprising flow channel unit 204 and actuator unit 121 is manufactured. Finally, after carrying out a connecting step of FPC 50, the inkjet head as described above is completed by finishing an attachment step of base block 71.

According to the inkjet head of the third embodiment described above, common electrode 34 and flow channel unit 204 can be electrically connected without having to scrape off thermosetting adhesive 6, which covers flow channel unit 204. This is because conductive member 231 and contact terminal 146 contact one another when flow channel unit 204 and actuator unit 121 are attached. As a result, a reliable connection can be made between common electrode 34 and flow channel unit 204 without clogging the ink channel within the head. Therefore, potential difference between common electrode 34 and flow channel unit 204 becomes zero, and migration becomes improbable. Further, since the connection passage that connects to the outside is formed on an attachment surface between actuator unit 121 and flow channel unit 204, gas from the conductive paste, generated during the heating process, can be effectively released to the outside. Accordingly, not only does the attachment between actuator unit 121 and flow channel unit 204 become more secure, but the electrical contact between conductive member 231 and contact terminal 146 becomes more reliable.

Figure 10:
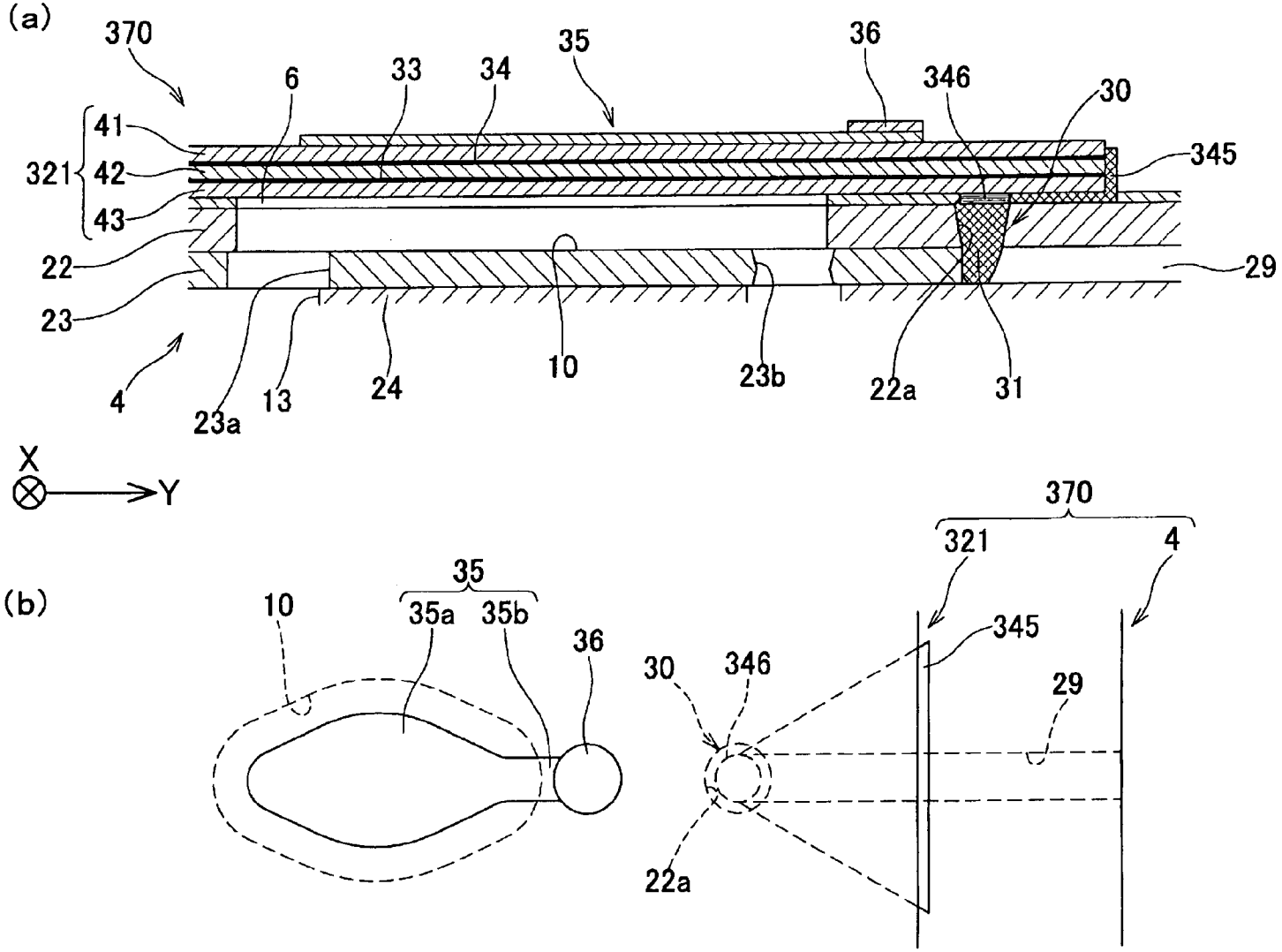
FIG. 10(*a*) is an enlarged cross-sectional diagram of an inkjet head according to a fourth embodiment of the present invention, and FIG. 10(*b*) is an enlarged planar diagram of a portion of an actuator unit.

Next, an inkjet head according to a fourth embodiment of the present invention will be described. FIG. 10 (*a*) is an enlarged cross-sectional diagram of a portion of inkjet head 370 according to the fourth embodiment of the present invention, and FIG. 10 (*b*) is an enlarged planar diagram of inkjet head 370. Components identical to the above-mentioned embodiments will be represented with the same notations, and their explanation will be shortened.

Actuator unit 321 of the inkjet head of the present embodiment, as shown in FIG. 10 (*a*), does not have holes or conductive wirings that penetrate piezoelectric sheets 41-43. Formed instead is conductive wiring 345, which electrically connects common electrode 34 and reinforcement electrode 33. Common electrode 34 and reinforcement electrode 33 extends to a peripheral border of the piezoelectric sheet 41, 42, 43 so as to become exposed at a side end surface of the actuator unit 321. As shown in FIG. 10 (*a*), conductive wiring 345 has a cross-sectional shape of an "L," and extends along a bottom surface of actuator unit 321 from one side end surface of actuator unit 321. Conductive wiring 345 is connected to common electrode 34 and reinforcement electrode 33 at their exposed side ends. A portion of conductive wiring 345 that extends on the bottom surface of actuator unit 321 has a planar shape of a triangle. That portion is contact terminal 346, wherein an acute-angle section contacts conductive member 31. Common electrode 34 is electrically connected to a contact point on FPC 50 at a region not shown in the figure, and is connected to ground. According to this configuration, common electrode 34 and reinforcement electrode 33 are equally maintained at ground in a region that corresponds to all pressure chambers 10, and contact terminal 346 and conductive member 31 contact one another. Therefore, as was the case with the first embodiment, flow channel unit 4 is maintained at ground potential. In other words, according to this configuration, there is no difference in electrical potential between flow channel unit 4 and actuator unit 321. Further, flow channel unit 4 is of the same configuration as the flow channel unit in the first embodiment.

<A Method of Manufacturing an Inkjet Head>

Next, a method of manufacturing inkjet head 370 according to the fourth embodiment will be explained. Flow channel unit 4 is formed with the same method of manufacturing as presented in the first embodiment (step 1). Inkjet head 370 is manufactured by attaching the fabricated actuator unit 321 with flow channel unit 4, according to steps 4-10 described above. In other words, the method of manufacturing inkjet head 370 of the fourth embodiment is the same as the first embodiment with the exception of steps 2 and 3. Inkjet head 370 of the fourth embodiment is otherwise manufactured by completing the same steps of manufacturing.

In order to fabricate actuator unit 321, three green sheets made of piezoelectric ceramics are prepared. The green sheets are formed beforehand with consideration to the shrinking that will result from the subsequent calcination. On the green sheet to become piezoelectric sheet 42, conductive paste is screen printed in a pattern corresponding to common electrode 34. On the green sheet to become piezoelectric sheet 43, conductive paste is screen printed in a pattern corresponding to reinforcement electrode 33. Then, using a jig, the green sheet with the conductive paste that was screen printed in a pattern corresponding to common electrode 34 is disposed directly below the green sheet without the conductive paste. Further, the green sheet with the conductive paste that was screen printed in a pattern corresponding to reinforcement electrode 33 is disposed directly below the conductive paste that was screen printed in a pattern corresponding to common electrode 34.

Next, the laminated body is degreased in the same way as heretofore known ceramics, and is calcinated at a predefined temperature. As a result, the three green sheets become piezoelectric sheets 41-43, and the conductive paste becomes common electrode 34, reinforcement electrode 33, and conductive wiring 113. Then, conductive paste is screen printed on top of the uppermost layer, piezoelectric sheet 41, in a pattern corresponding to individual electrodes 35. Then, the conductive paste is calcinated by performing a heating process on the laminated body, and individual electrodes 35 are formed on piezoelectric sheet 41. Land 36 is subsequently formed by printing metal that includes glass flits on auxiliary electrode region 35*b* of each individual electrode 35.

Figure 11:
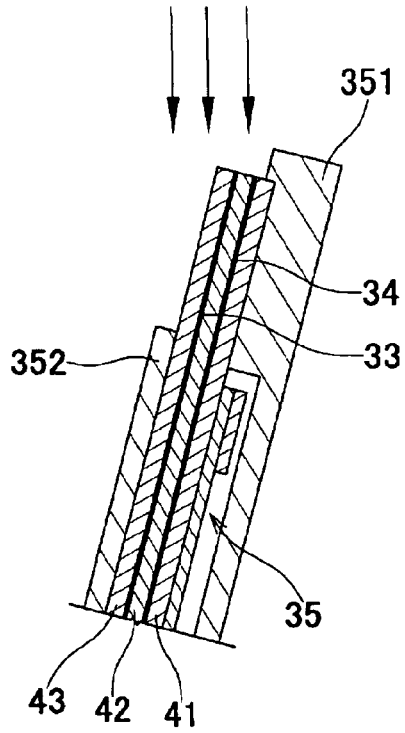
FIG. 11(*a*) is a diagram showing a condition before a conductive wiring is formed on an actuator unit, and FIG. 11 (*b*) is a diagram showing a condition after the conductive wiring has been formed on the actuator unit.
Figure 11:
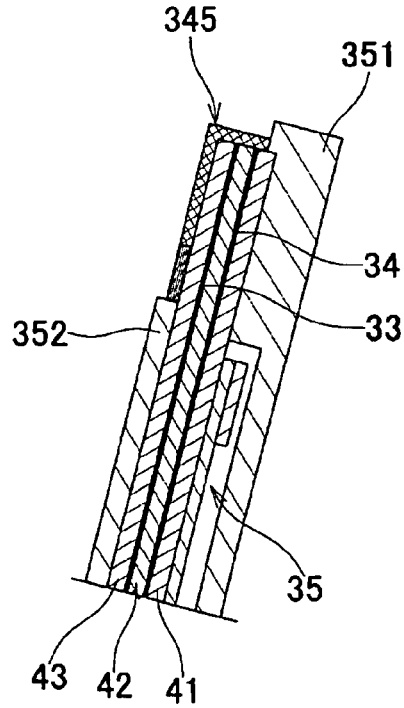

Next, conductive wiring 345 is formed on one side end surface of the laminated body and on a bottom surface of the laminated body. FIG. 11 (*a*) shows a condition before conductive wiring 345 is formed on actuator unit 321, and FIG. 11 (*b*) shows a condition after conductive wiring 345 has been formed on actuator unit 321. As shown in FIG. 11 (*a*), the laminated body is mounted on platform 351, and mask 352 is applied over a region on the laminated body where conductive wiring 345 will not be formed. Then, the laminated body and platform 351 are tilted to a predetermined angle, and conductive particles to become conductive wiring 345 are deposited using PVD (Physical Vapor Deposition). In this way, as shown in figure 11 (*b*), conductive wiring 345 can be formed simultaneously on a part of an side end surface of the laminated body and a part of the bottom surface of the laminated body. Further, by changing the deposition direction, a thickness of conductive wiring 345 on the side end surface of actuator unit 321 and a thickness of conductive wiring 345 on the bottom surface of actuator unit 321 can be easily adjusted. In this way, actuator unit 321 as shown in FIG. 10 (*a*) can be fabricated.

According to inkjet head 370 of the fourth embodiment described above, as was the case with the first embodiment, common electrode 34 and flow channel unit 4 can be electrically connected without having to scrape off thermosetting adhesive 6, which covers flow channel unit 4. This is because conductive member 31 and contact terminal 346 contact one another when flow channel unit 4 and actuator unit 321 are attached. Therefore, the potential difference between common electrode 34 and flow channel unit 4 becomes zero, and migration becomes improbable. Further, since conductive wiring 345 is formed on actuator unit 321 at the side end surface and at the attachment surface, to which flow channel unit 4 is attached, common electrode 34, reinforcement electrode 33, and contact terminal 146 can be electrically connected all at once. In addition, since conductive wiring 345 is formed on a surface of actuator unit 321, the strength of actuator unit 321 increases relative to having the conductive wiring built inside the actuator unit. In other words, since there is no need to form holes on piezoelectric sheets 41-43 for the conductive wirings, the strength of piezoelectric sheets 41-43 does not decrease. Further, because conductive wiring 345 is formed with a thin-film method such as the PVD method, a reliable conductivity can be attained even if the wiring is submicron in thickness. Therefore, when attaching actuator unit 321 and flow channel unit 4, the thickness of conductive wiring 345 does not obstruct the attachment. For example, the thickness may be 0.1 μm-0.5 μm, but it may also be approximately 2 μm. However, a thickness of 1 μm or greater is preferable for the most reliable connection.

Figure 12:
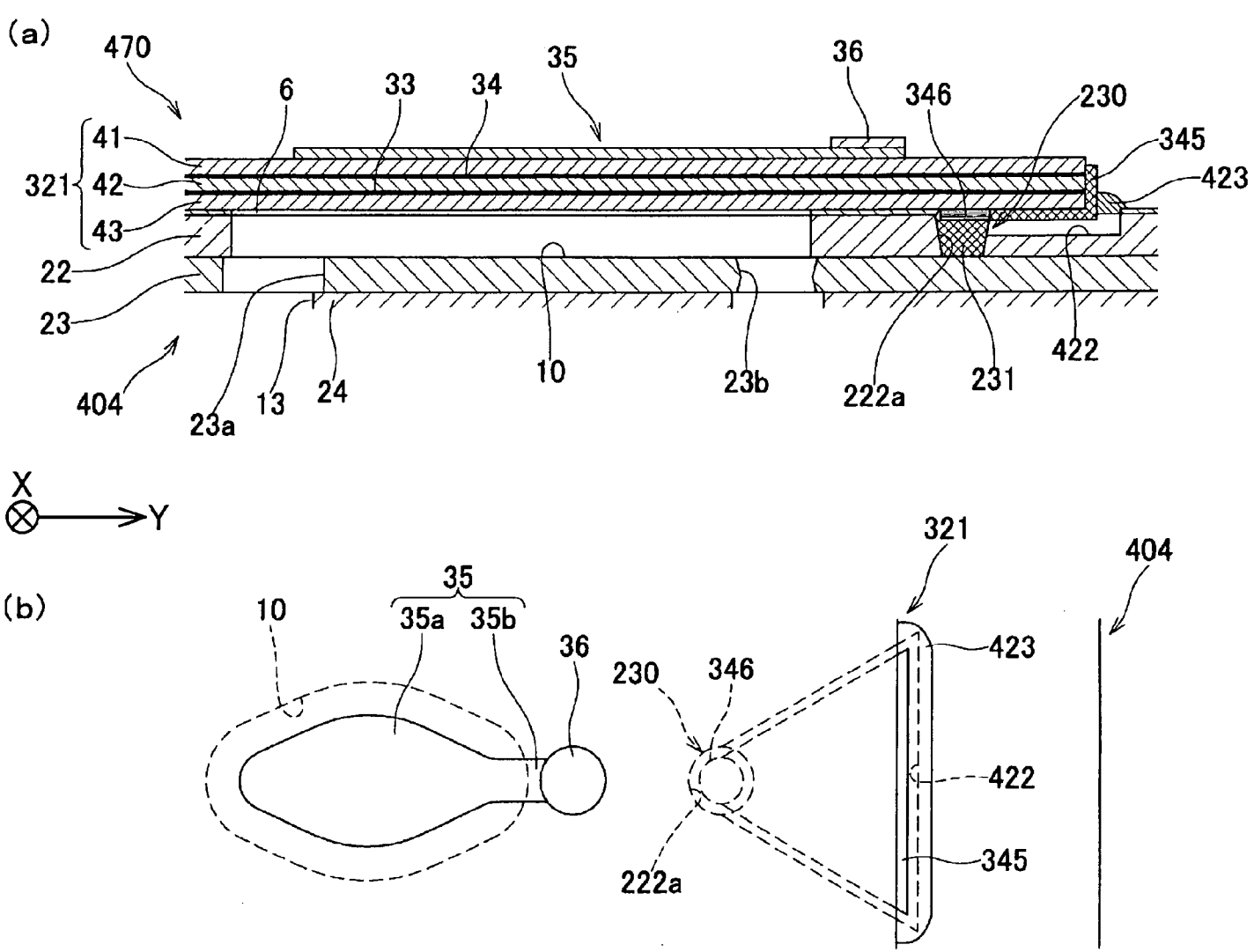
FIG. 12 (*a*) is an enlarged cross-sectional diagram of an inkjet head according to a fifth embodiment of the present invention, and FIG. 12 (*b*) is an enlarged planar diagram of a portion of an actuator unit.

Next, an inkjet head 470 according to a fifth embodiment of the present invention will be described. FIG. 12 (*a*) is an enlarged cross-sectional diagram of inkjet head 470 according to the fifth embodiment of the present invention, and FIG. 12 (*b*) is an enlarged planar diagram of a portion of inkjet head 470. Components identical to the above-mentioned embodiments will be represented with the same notations, and their explanation will be shortened.

Inkjet head 470 of the present embodiment, as shown in FIG. 12 (*a*), is a laminated structure that has actuator unit 321 of the fourth embodiment stacked on top of flow channel unit 404, which is similar to flow channel unit 204 of the third embodiment. Flow channel unit 404 is equivalent to flow channel unit 204, with the exception that groove 422, formed on cavity plate 22, has a planar shape that is slightly different from groove 222*b* of flow channel unit 204 described above. As shown in FIG. 12 (*b*), groove 422 has a planar shape of a triangle, which is slightly bigger than but nearly equivalent to a planar shape of a section formed on a bottom surface of actuator unit 321 of conductive wiring 345. Groove 422 extends from hole 222*a* to a region that does not face actuator unit 321. When flow channel unit 404 and actuator unit 321 are fabricated and attached together with thermosetting adhesive 6, a portion of conductive wiring 345 is placed inside groove 422, enabling a higher degree of adhesion. In other words, forming groove 422 on flow channel unit 404 can prevent conductive wiring 345 from interfering with the attachment between flow channel unit 404 and actuator unit 321. This enables secure contact between contact terminal 346 of actuator unit 321 and conductive member 231. Therefore, as with the above-mentioned embodiments, there is no potential difference between flow channel unit 404 and actuator unit 321. Further, an outlet of a connection passage framed by groove 422 and a bottom surface of actuator unit 321 is sealed with sealing material 423 after flow channel unit 404 and actuator unit 321 are attached. As with the previous embodiments, this can prevent ink spew or dust from entering cavity 230 through the connection passage. Further, depending on a depth of groove 422, when forming conductive wiring 345, there may be no need to use the thin-film method which was used in the previous embodiments, and the thickness of conductive wiring 345 can be controlled more freely. For example, printing methods that form thicker conductive wirings 345 can be used, which contributes to cost reduction.

According to the fifth embodiment described above, as with the inkjet heads of the previous embodiments, common electrode 34 and flow channel unit 404 can be electrically connected without having to scrape off thermosetting adhesive 6, which covers flow channel unit 404. This is because conductive member 231 and contact terminal 346 contact one another when flow channel unit 404 and actuator unit 321 are attached. Therefore, the potential difference between common electrode 34 and flow channel unit 404 becomes zero, and migration becomes improbable.

Preferable embodiments of the present invention have been described above, but the present invention is not limited to such embodiments, and various modifications are possible within the scope of the claims. For example, a cavity that penetrates a cavity plate is formed on a flow channel unit of each of the above-mentioned embodiments, but the cavity does not need to penetrate the cavity plate. Further, a connection passage that connects a cavity to the outside is not a necessity. Further, a diameter of a cavity does not need to get smaller as the cavity extends away from an actuator unit. Further, a cavity may be of any planar shape. Further, an outlet of a connection passage does not need to be sealed with a sealing material. Further, the flow channel unit, common electrode, and reinforcement electrode can be directly grounded without using the connection points on an FPC, even though the actuator unit of each of the above-mentioned embodiments connects the common electrode, reinforcement electrode, and flow channel unit to ground via the connection points of the FPC. The actuator unit and the flow channel will still be maintained at ground potential, and the potential difference will still be zero. Further, a common electrode may be supplied with a predefined electrical potential. Even so, the potential difference between the actuator unit and the flow channel unit will be zero because the common electrode, reinforcement electrode, and flow channel unit are still electrically connected and are at the same electrical potential. Therefore, migration becomes improbable.

In order to increase reliability of the connection between a flow channel unit and a common electrode, conductive members 31, 131, and 231 disposed on the flow channel units 4, 104, 204, and 404 are connected to contact terminals 46, 146, and 346 disposed on the actuator units 21, 121, and 321 at the attachment surfaces to attach to flow channel units 4, 104, 204, and 404. To further increase reliability of the connection, a conductive film layer that is different from the contact terminal may be installed on at least a portion of the attachment surfaces of the actuator units 21, 121, and 321. In each of the above-mentioned embodiments, flow channel units 4, 104, 204, and 404 are fixed to actuator units 21, 121, and 321 with an adhesive. Though it depends on the amount and thickness of the applied adhesive, the attachment surfaces on both units are uneven and are not so-called mirrored surfaces. Therefore, there are parts within the contact region where both surfaces penetrate the adhesive layer and make direct contact with each other. At this time, if a conductive thin-film layer that conducts with the common electrode is formed on the actuator unit 21, 121, and 321 sides, the flow channel unit and the common electrode become electrically connected via those contact sections, making the connection between the flow channel unit and the common electrode more reliable.

Figure 13:
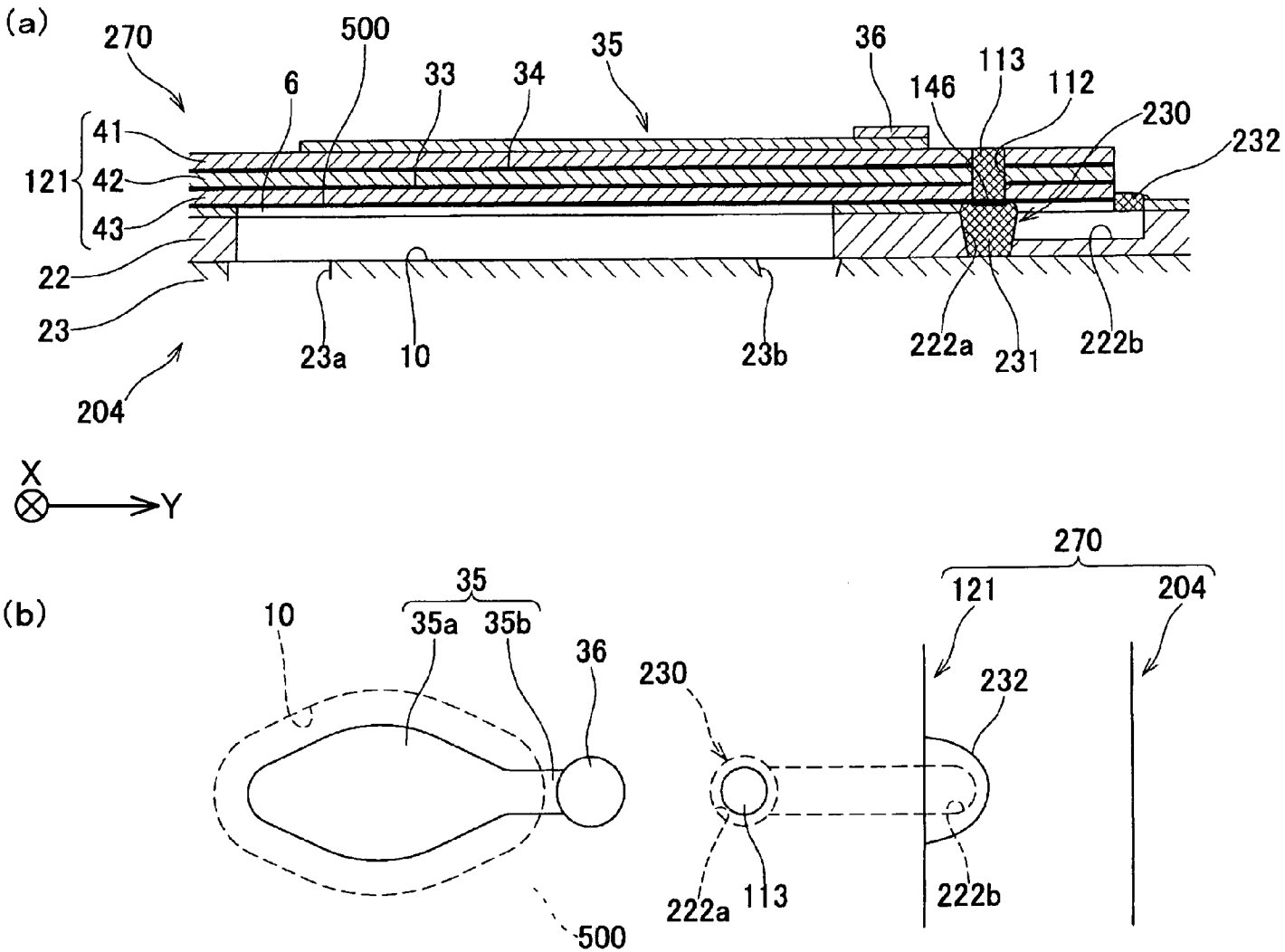
FIG. 13 (*a*) is an enlarged cross-sectional diagram of an inkjet according to a transfiguration example based on the third embodiment of the present invention, and FIG. 13 (*b*) is an enlarged planar diagram of an actuator unit.

As one specific example related to this, a transfiguration example based on the above-mentioned third embodiment will be explained with reference to FIG. 13. In FIG. 13, components that are the same as those in the third embodiment will be referred to with the same notation, and their explanation will be shortened. In this transfiguration example, as shown in FIG. 13, nearly the entire region on the attachment surface side of actuator unit 121 is covered with conductive thin-film layer 500 so as to electrically connect to contact terminal 146. Nickel is used as the material for thin-film layer 500. The nickel layer is formed by an electrode-less plating method. According to this configuration, flow channel unit 204 and thin-film layer 500 can be expected to make direct contact within an attachment region. Further, as shown in FIG. 13, an upper-side opening of pressure chamber 10 is sealed by thin-film layer 500. In other words, an inner wall of pressure chamber 10 is constructed on a wall surface that electrically connects to common electrode 34, and flow channel unit 204 in its entirety, including the ink, can be connected to ground. Accordingly, damages to actuator unit 121 can be effectively prevented. With regards to thin-film layer 500, any material can be used as the conductive material if the material does not dissolve or react and erode due to the ink. Besides nickel, usable materials may include mono-layer, multi-layers, or alloy-layers such as gold, titanium, palladium, platinum, and aluminum. Further, a suitable method of forming thin-film 500 may be selected based on the material. For example, instead of the plating method, a deposition method, sputter technique, and CVD method can also be used.

As described in preferred embodiments, it is preferable that an area of an opening section of the cavity is larger than an area of a bottom section thereof. In this case, it becomes easier for the conductive material filled in the cavity to pile up near the opening section. As a result, the conductive material protrudes upward and can be securely connected to the contact terminal.

In addition, it is preferable that the flow channel unit further has a connection passage that connects the cavity to the outside air. This can prevent unwanted pressure from building inside the cavity because solvent gas, which is generated from the conductive material when the conductive material is hardened, is released to the outside air through the connection passage.

Further, at this time, an opening of the connection passage to the outside air may be sealed. This can prevent ink spew or dust from entering the cavity through the connection passage.

In addition, it is also preferable that the flow channel unit is equipped with a spare chamber connected to the cavity. This enables solvent gas generated from the conductive material to be released to the spare chamber, which can prevent unwanted pressure from building inside the cavity.

Further, with regards to the present invention, it is preferable that the common electrode extends to a peripheral border of the piezoelectric sheet so as to become exposed at a side end surface of the actuator unit. In this case, it is preferred that the actuator unit further includes a conductive wiring. The conductive wiring is formed continuously from the side end surface of the actuator unit and the attachment surface of the actuator unit, and the conductive wiring electrically connects the common electrode and the contact terminal. This enables the conductive wiring to be formed without decreasing the strength of the actuator unit.

Further, the connection passage may be a groove formed on the attachment surface of the flow channel unit. The groove faces at least a portion of the conductive wiring formed on the attachment surface of the actuator unit. This enables the conductive wiring to be formed without decreasing the strength of the actuator unit, and prevents interference between the conductive wiring and the flow channel unit. As a result, a more secure attachment between the flow channel unit and the actuator unit can be obtained.

Further, with regards to the present invention, it is also preferable that the actuator unit comprises a conductive wiring that is formed within the actuator unit. The conductive wiring extends along a direction orthogonal to the attachment surface of the actuator unit and electrically connects the common electrode with the contact terminal. This protects the conductive wiring from ink spew or dust because the conductive wiring is not exposed to the outside.

In addition, at this time, the actuator unit may further has a reinforcement electrode, disposed parallel to the common electrode on an opposite side of where the plurality of individual electrodes is disposed with respect to the common electrode. The conductive wiring may be directly connected to the common electrode and the reinforcement electrode, and may penetrate the actuator unit. This enables the common electrode and the contact terminal to be electrically connected all at once.

In addition, at this time, the actuator unit may further has a reinforcement electrode electrically connected to the common electrode and disposed parallel to the common electrode on an opposite side of where the plurality of individual electrodes is disposed with respect to the common electrode. The conductive wiring may be directly connected to at least one of the common electrode and the reinforcement electrode. In addition, the conductive wiring does not need to penetrate the actuator unit. As a result, since the conductive wiring does not penetrate the actuator unit, the conductive wiring is unlikely to get unhooked from the actuator unit when the actuator unit is pressurized.

With regards to the method of manufacturing the inkjet head, it is preferable that the step of fabricating the flow channel unit further includes a step of forming a connection passage to connect the cavity to the outside air. Further, it is preferable that the method of manufacturing the inkjet head includes a step of sealing an opening of the connection passage to the outside air. This step may be performed after the actuator unit and the flow channel unit are attached. This can prevent unwanted pressure from building inside the cavity and protects the conductive material from ink spew or dust because the opening is sealed after the solvent gas is released to the outside air through the connection passage.

Further, after forming the common electrode, which extends to a peripheral border of the piezoelectric sheet so as to become exposed at a side end surface of the actuator unit, it is preferable that the step of fabricating the actuator unit further includes a step of forming a conductive wiring to electrically connect the contact terminal and the common electrode. This may done by covering the side end surface and the attachment surface of the actuator unit with a mask so that at least a portion of the side end surface and the attachment surface becomes exposed, and then depositing a conductive member by using a physical vapor deposition method on a region of the side end surface and the attachment surface exposed from the mask. This enables the conductive wiring to be formed on the side end surface and on the attachment surface of the actuator unit at the same time. In addition, by changing the deposition direction, the thickness of the conductive wiring on the side end surface and on the attachment surface of the actuator unit can be adjusted.

Further, with regards to the present invention, it is preferable that the step of fabricating the actuator unit further includes a step of forming a conductive wiring to electrically connect the contact terminal and the common electrode by stacking an insulating layer with a penetration hole formed perpendicularly to the attachment surface of the actuator unit, and filling the penetration hole with a conductive member. This enables the contact terminal and the conductive wiring to be formed with ease.

What is claimed is:

1. An inkjet head, comprising:

a flow channel unit comprising:

a plurality of nozzles; and a plurality of pressure chambers, each pressure chamber being connected to a uniquely corresponding nozzle; and an actuator unit attached to the flow channel unit, the actuator unit comprising:

a piezoelectric sheet;

a plurality of individual electrodes, each individual electrode facing a uniquely corresponding pressure chamber; and a common electrode which, with the plurality of individual electrodes, sandwiches the piezoelectric sheet;

wherein a contact terminal electrically connected to the common electrode is exposed on an attachment surface of the actuator unit to attach to the flow channel unit, wherein a cavity facing the contact terminal is formed in the flow channel unit and an opening of the cavity is formed at an attachment surface of the flow channel unit to attach to the actuator unit, and wherein a conductive material filled in the cavity electrically connects the contact terminal of the actuator unit with the flow channel unit.

2. The inkjet head of claim 1, wherein an area of an opening section of the cavity is larger than an area of a bottom section of the cavity.

3. The inkjet head of claim 1, wherein the flow channel unit further comprises a connection passage connecting the cavity to the outside air.

4. The inkjet head of claim 3, wherein an opening of the connection passage to the outside air is sealed.

5. The inkjet head of claim 1, wherein the actuator unit further comprises a conductive wiring formed within the actuator unit, the conductive wiring extending along a direction orthogonal to the attachment surface of the actuator unit, and electrically connecting the common electrode with the contact terminal.

6. The inkjet head of claim 5, wherein the actuator unit further comprises a reinforcement electrode electrically connected to the common electrode and disposed parallel to the common electrode on an opposite side of where the plurality of individual electrodes is disposed with respect to the common electrode, wherein the conductive wiring is directly connected to at least one of the common electrode and the reinforcement electrode, and wherein the conductive wiring does not penetrate the actuator unit.

7. The inkjet head of claim 1, wherein the flow channel unit further comprises a spare chamber connected to the cavity.

8. The inkjet head of claim 1, wherein the common electrode extends to a peripheral border of the piezoelectric sheet so as to become exposed at a side end surface of the actuator unit, and wherein the actuator unit further comprises a conductive wiring, formed continuously between the side and surface of the actuator unit and the attachment surface of the actuator unit, and electrically connecting the common electrode with the contact terminal.

9. The inkjet head of claim 3, wherein the common electrode extends to a peripheral border of the piezoelectric sheet so as to become exposed at a side end surface of the actuator unit, wherein the actuator unit further comprises a conductive wiring, formed continuously between the side end surface of the actuator unit and the attachment surface of the actuator unit, and electrically connecting the common electrode with the contact terminal, and wherein the connection passage is a groove formed on the attachment surface of the flow channel unit, the groove facing at least a portion of the conductive wiring formed on the attachment surface of the actuator unit.

10. The inkjet head of claim 5, wherein the actuator unit further comprises a reinforcement electrode disposed parallel to the common electrode on an opposite side of where the plurality of individual electrodes is disposed with respect to the common electrode, wherein the conductive wiring is directly connected to the common electrode and the reinforcement electrode, and wherein the conductive wiring penetrates the actuator unit.

* * * * *